US011282663B1

(12) United States Patent
Kawale et al.

(10) Patent No.: US 11,282,663 B1
(45) Date of Patent: Mar. 22, 2022

(54) COMPACT LOW AMPERAGE SHUNT SOLENOID ASSEMBLY FOR 12V TO 48V AC/DC SUPPLY

(71) Applicant: EATON INTELLIGENT POWER LIMITED, Dublin (IE)

(72) Inventors: Srushti Kawale, Chandrapur (IN); Abhinav Pandey, Sultanpur (IN); Karthik Satyanarayanan, Vellore (IN); Jeffrey Cox, Venetia, PA (US); Projesh Basu, Hooghly (IN); Edward V. Stout, Beaver, PA (US); Akshay Jamdade, Pune (IN); Rajesh Londhe, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/136,322

(22) Filed: Dec. 29, 2020

(51) Int. Cl.
*H01H 71/04* (2006.01)
*H01H 71/46* (2006.01)
*H01H 71/02* (2006.01)

(52) U.S. Cl.
CPC ..... *H01H 71/04* (2013.01); *H01H 71/465* (2013.01); *H01H 2071/0278* (2013.01)

(58) Field of Classification Search
CPC ..... H01H 71/04; H01H 71/465; H01H 2071/0278
USPC ..... 335/13
See application file for complete search history.

(56) References Cited

U.S. PATENT DOCUMENTS 4,209,761 A * 6/1980 Klein ..... H01H 71/462 200/308
5,581,219 A * 12/1996 Nozawa ..... H01H 71/0228 335/132
5,910,758 A 6/1999 Maloney et al.
6,040,746 A * 3/2000 Maloney ..... H01H 71/46 200/330
6,218,921 B1 4/2001 Eberts et al.
6,400,242 B1 * 6/2002 Fasano ..... H01H 71/465 200/18
6,414,601 B1 7/2002 Massedonio
6,584,997 B1 7/2003 Blichmann et al.
8,368,489 B2 * 2/2013 Sohn ..... H01H 83/20 335/17
9,184,571 B2 11/2015 Lias et al.
9,368,959 B2 6/2016 Wright, Jr. et al.
(Continued)

FOREIGN PATENT DOCUMENTS

CA 2121850 12/1994

*Primary Examiner* — Alexander Talpalatski
(74) *Attorney, Agent, or Firm* — Eckert Seamans Cherin & Mellott, LLC

(57) ABSTRACT

A shunt trip assembly structured to be operatively coupled to a number of circuit breakers uses a lever to actuate an operating mechanism of the circuit breakers and uses a selectively powered solenoid to power the lever. The shunt trip assembly is composed from a standardized shunt assembly designed for use with a plurality of different solenoid coils, such that a given standardized shunt assembly will be operative regardless of which of the solenoid coils are added to the standardized shunt assembly. The shunt trip assembly requires less than 10 amps of current to operate; can be powered by any of a 12 volt AC/DC, 24 volt AC/DC, or 48 volt AC/DC power source; and is functional in temperatures ranging from −40° C. to +60° C.

20 Claims, 17 Drawing Sheets

(56) References Cited

U.S. PATENT DOCUMENTS

| | | | |
|---|---|---|---|
| 10,107,260 | B2 | 10/2018 | Ritter et al. |
| 10,215,146 | B2 | 2/2019 | Schnellinger et al. |
| 2007/0188335 | A1 | 8/2007 | Shea |
| 2008/0246569 | A1 | 10/2008 | Bogdon et al. |
| 2015/0213989 | A1 | 7/2015 | Kasprzycki et al. |
| 2017/0331275 | A1 | 11/2017 | White |
| 2019/0081458 | A1 | 3/2019 | Lapushner et al. |
| 2019/0131090 | A1 | 5/2019 | Dixit et al. |

* cited by examiner

COMPACT LOW AMPERAGE SHUNT SOLENOID ASSEMBLY FOR 12V TO 48V AC/DC SUPPLY

BACKGROUND OF THE INVENTION

Field of the Invention

The disclosed and claimed concept relates to a miniature circuit breaker installation and, more specifically, to a shunt trip assembly for a miniature circuit breaker installation.

Background Information

Circuit interrupters, such as for example and without limitation, circuit breakers such as miniature circuit breakers, are typically used to protect electrical circuitry from damage due to an overcurrent condition, such as an overload condition, a short circuit, or another fault condition, such as an arc fault or a ground fault. Circuit breakers typically include an operating mechanism and a pair of separable contacts, the separable contacts operating as a switch. When the separable contacts are closed such that they are in electrical contact with one another, current is able to flow through any circuits connected to the circuit interrupter. When the separable contacts are open such that they are not in electrical contact with one another, current is prevented from flowing through any circuits connected to the circuit interrupter. The separable contacts typically include a fixed contact and a movable contact, and the operating mechanism is operatively coupled to the movable contact and configured to move the movable contact between the open and closed states. The operating mechanism can be said to be in a closed configuration when the separable contacts are closed and said to be in an open configuration when the separable contacts are open.

The circuit breaker operating mechanism may be actuated to open the separable contacts either manually by way of a handle, automatically by a trip unit in response to an overcurrent condition, or remotely via a shunt trip assembly. For manual operation, a handle is operatively coupled to the operating mechanism and structured to move the operating mechanism between at least the open and closed configurations. For automatic operation in response to an overcurrent condition, the circuit breaker includes a trip unit which senses overcurrent conditions and actuates the operating mechanism to open the separable contacts in response to sensing an overcurrent condition. For remote operation via a shunt trip assembly, the shunt trip assembly typically includes a shunt trip operating mechanism that is coupled to the circuit breaker operating mechanism by a mechanical linkage such that movement in the shunt trip operating mechanism causes corresponding movement in the circuit breaker operating mechanism. The shunt trip assembly is additionally operatively coupled to a remote actuator that is structured to actuate the shunt trip operating mechanism so that an operator at a remote location can open the circuit breaker separable contacts. That is, a remote operator can actuate the circuit breaker operating mechanism to open the separable contacts by actuating the shunt trip assembly with the remote actuator.

To be effective, a shunt trip assembly must be capable of actuating the operating mechanism of an associated circuit breaker to open the separable contacts very quickly. The electrical components of a shunt trip assembly that enable quick actuation of the circuit breaker operating mechanism are often rated for use under a set of specific operating conditions, and a shunt trip assembly produced for use under one set of operating conditions may not be suitable for use under a different set of operating conditions and vice versa. The inability to employ a particular shunt trip assembly under more than one set of conditions can cause production inefficiencies.

Accordingly, there is room for improvement in electrical switching apparatus, such as circuit breakers, and in shunt trip assemblies therefor.

SUMMARY OF THE INVENTION

These needs and others are met by embodiments of the disclosed concept in which a shunt trip assembly for a circuit breaker installation includes a micro switch, a solenoid, a ferromagnetic plunger coupled to the solenoid so as to be movably disposed within the solenoid, and a lever member operatively coupled at its fulcrum to the operating mechanism of an associated circuit breaker and coupled at one arm to the plunger, where power can be selectively provided to the solenoid through the micro switch, where the solenoid is activated when it receives AC or DC Voltage, where the solenoid pulls the plunger further into the housing of the solenoid when activated, where the movement of the plunger into the solenoid causes rotation of the lever and actuation of the operating mechanism of the associated circuit breaker to open the separable contacts, and where rotation of the lever also causes the micro switch to cut off power to the solenoid. Exclusive of the solenoid, the entire shunt trip assembly is produced as a standardized assembly structured to fit within both a single housing shunt enclosure for a ¾-inch circuit breaker installation and a double housing shunt enclosure for a 1-inch circuit breaker installation. Any one of three different wound wire solenoid models can be added to the standardized shunt trip assembly. A first of the three solenoid models is structured to operate with a 12V AC/DC supply voltage while drawing 10.5 A current, a second of the three solenoid models is structured to operate with a 24V AC/DC supply voltage while drawing less than 10 A current, and a third of the three solenoid models is structured to operate with a 48V AC/DC supply voltage while drawing less than 10 A current. The standardized shunt assembly is configured such that, for all temperatures ranging from −40° C. to +60° C., regardless of which of the three solenoids is used, the solenoid generates a force greater than or equal to a predetermined minimum force, the predetermined minimum force being the minimum force with which the plunger must pull on the lever to actuate the associated circuit breaker operating mechanism to open the separable contacts and cut off power supplied by the micro switch to the solenoid. The 10 A current pull by all three solenoid designs enables use of an off the shelf small size micro switch rated for a 10 A DC supply.

In accordance with one aspect of the disclosed concept, a shunt trip assembly structured to be operatively coupled to a number of circuit breakers includes a standardized shunt arrangement and a solenoid coil. The standardized shunt arrangement includes: a shunt housing comprising a mounting wall; a micro switch, the micro switch being coupled to the mounting wall and configured to be selectively powered by a power source; a solenoid frame coupled to the mounting wall; a solenoid housing coupled to the solenoid frame; a bobbin contained within the solenoid housing; a ferromagnetic plunger movably coupled to the solenoid housing so as to be disposed partially within the solenoid housing; and a lever member coupled at a fulcrum of the lever member to the mounting wall via an axle, the lever member comprising a first arm disposed between the fulcrum and a first end of the lever member with the first end of the lever member being coupled to the plunger, a second arm disposed between the fulcrum and a second end of the lever member with the second end being disposed opposite the first end and adjacent to the micro switch arm, and a rotational coupling body coupled to the fulcrum and structured to be operatively coupled to an operating mechanism of the number of circuit breakers. The solenoid coil is comprised of a conductive wire structured to be wound around the bobbin within the solenoid housing and structured to receive power from the micro switch. The micro switch is structured to provide current from the power source to the solenoid in response to the micro switch receiving power when in a closed state, the plunger is structured to move further into the solenoid housing and cause the lever member to rotate the rotational coupling body to actuate the operating mechanism of the number of circuit breakers in response to the solenoid receiving current, and the lever member is structured to switch the micro switch to an open state and disconnect the solenoid from the power source in response to the plunger causing the lever member to rotate. The standardized shunt arrangement is configured to be used with a plurality of AC and DC voltage levels provided by the power source. The solenoid coil is structured to be powered by one specified voltage level from the plurality of AC and DC voltage levels and to draw less current from the power source than the maximum current for which the micro switch is rated. The standardized shunt arrangement is configured and the solenoid and plunger are structured such that, for a range of temperatures spanning −40° C. to +60° C. and regardless of what specified voltage level the solenoid is structured to be powered by, the plunger exerts a predetermined amount of force on the first end of the lever member when current is provided to the solenoid from the power source.

In accordance with another aspect of the disclosed concept, a shunt trip assembly structured to be operatively coupled to a number of circuit breakers, includes a standardized shunt arrangement and a solenoid coil. The standardized shunt arrangement includes: a shunt housing comprising a mounting wall; a micro switch, the micro switch being coupled to the mounting wall and configured to be selectively powered by a power source; a solenoid frame coupled to the mounting wall; a solenoid housing coupled to the solenoid frame; a bobbin contained within the solenoid housing; a ferromagnetic plunger movably coupled to the solenoid housing so as to be disposed partially within the solenoid housing; and a lever member coupled at a fulcrum of the lever member to the mounting wall via an axle, the lever member comprising a first arm disposed between the fulcrum and a first end of the lever member with the first end of the lever member being coupled to the plunger, a second arm disposed between the fulcrum and a second end of the lever member with the second end being disposed opposite the first end and adjacent to the micro switch arm, and a rotational coupling body coupled to the fulcrum and structured to be operatively coupled to an operating mechanism of the number of circuit breakers. The solenoid coil is comprised of a conductive wire structured to be wound around the bobbin within the solenoid housing and structured to receive power from the micro switch. The micro switch is structured to provide current from the power source to the solenoid in response to the micro switch receiving power when in a closed state, the plunger is structured to move further into the solenoid housing and cause the lever member to rotate the rotational coupling body to actuate the operating mechanism of the number of circuit breakers in response to the solenoid receiving current, and the lever member is structured to switch the micro switch to an open state and disconnect the solenoid from the power source in response to the plunger causing the lever member to rotate. The standardized shunt arrangement is configured to be used with a plurality of AC and DC voltage levels provided by the power source, including 12 volts AC/DC, 24 volts AC/DC, and 48 volts AC/DC. The solenoid coil is structured to be powered by one specified voltage level from the plurality of AC and DC voltage levels and to draw less current from the power source than the maximum current for which the micro switch is rated. The standardized shunt arrangement is configured and the solenoid and plunger are structured such that, for a range of temperatures spanning −40° C. to +60° C. and regardless of what specified voltage level the solenoid is structured to be powered by, the plunger exerts a predetermined amount of force on the first end of the lever member when current is provided to the solenoid from the power source.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1A:
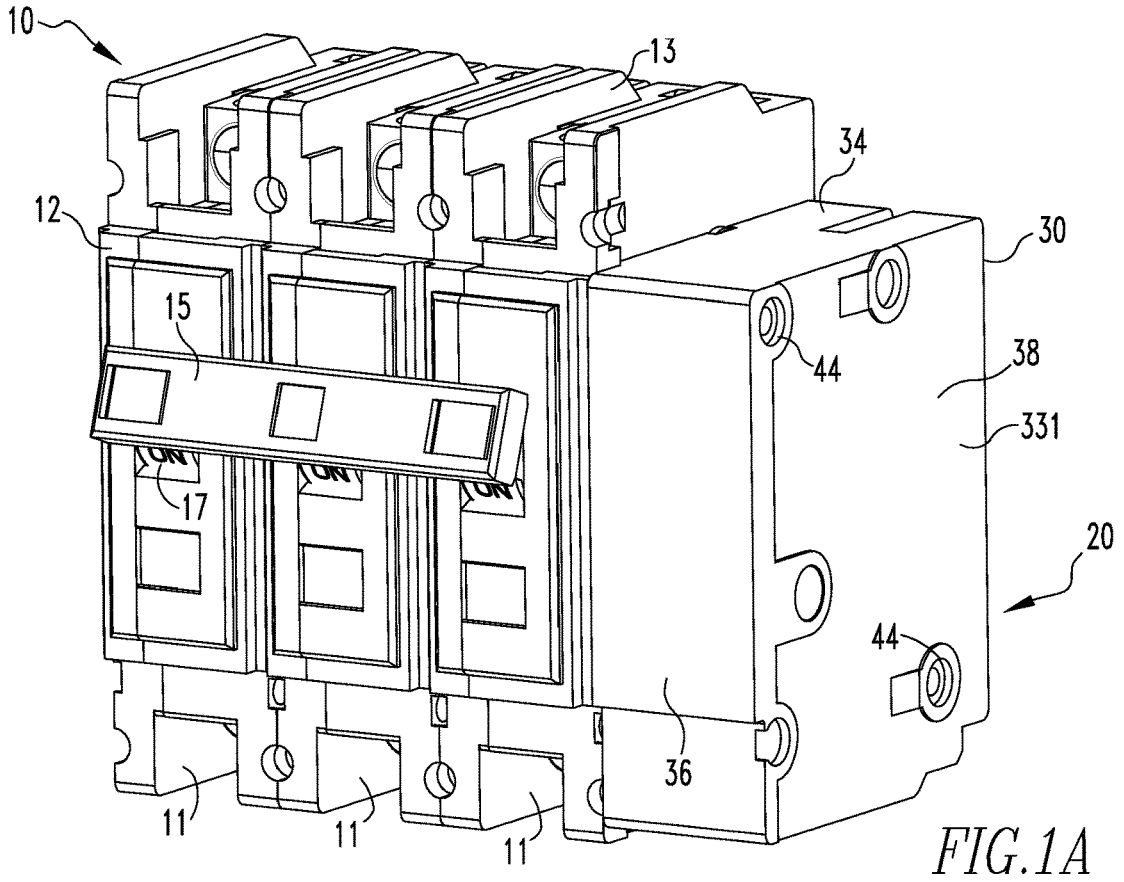
FIG. 1A is an isometric view of a circuit breaker installation including a lever-based shunt trip assembly with a single housing shunt housing design, in accordance with an exemplary embodiment of the disclosed concept.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As used herein, the singular form of "a", "an", and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. As used herein, "movably coupled" means that two components are coupled so as to allow at least one of the components to move in a manner such that the orientation of the at least one component relative to the other component changes.

As used herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

Figure 1B:
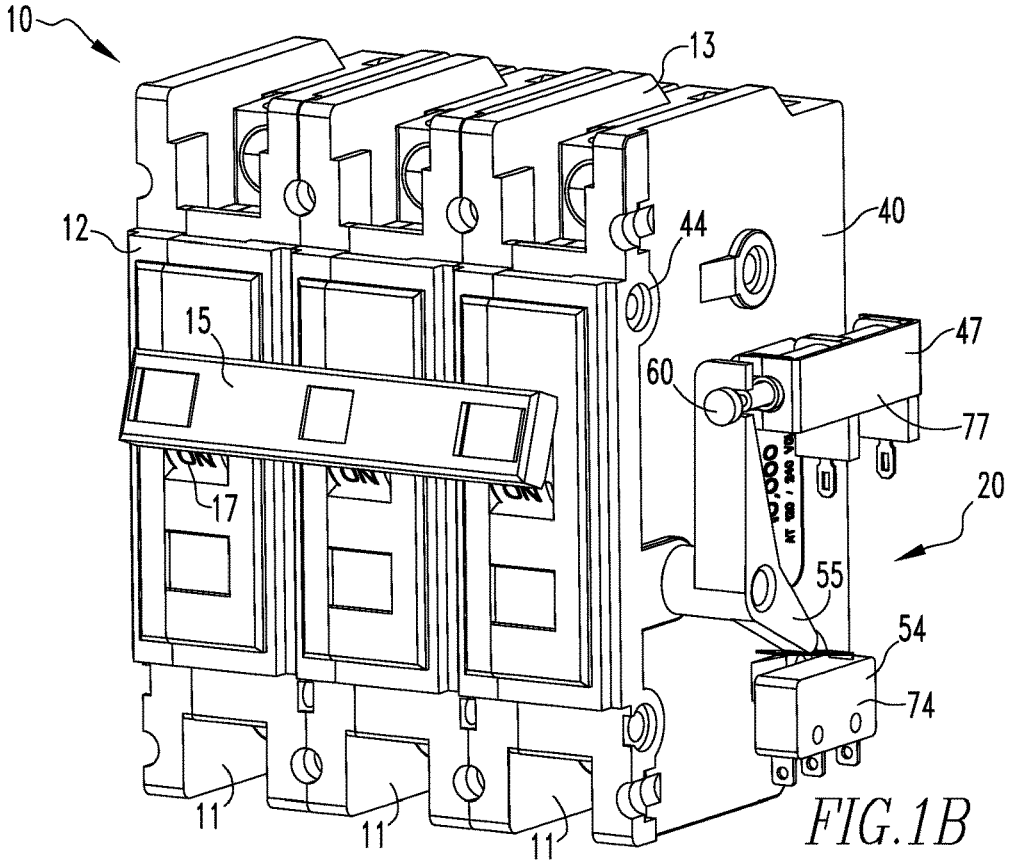
FIG. 1B is an isometric view of the circuit breaker installation shown in FIG. 1A with the single housing of the lever-based shunt trip assembly removed and a double bay solenoid included in the shunt trip assembly.

Referring to FIGS. 1A and 1B, a circuit breaker installation 10 includes a number of circuit breakers 11 (three shown) and a lever-based shunt trip assembly 20, in accordance with an exemplary embodiment of the disclosed concept. The circuit breaker installation 10 is disposed in an enclosure (not shown) and is in electrical communication with a number of conductive members such as, but not limited to, line and load conductors. Referring to FIG. 1A, the housing 12 of each circuit breaker 11 includes at least one sidewall 13 immediately adjacent to a sidewall 13 of the housing 12 of an adjacent circuit breaker 11. Each such sidewall 13 includes a passage whereby a mechanical linkage (not shown) extends between the operating mechanisms 14 (shown in FIGS. 2, 4, and 6) of adjacent circuit breakers 11. The mechanical linkage operatively couples the operating mechanisms 14 of the adjacent circuit breakers 11 such that all of the circuit breaker operating mechanisms 14 are disposed in the same configuration at any given time. The handles 17 of the associated circuit breakers 11 are also mechanically coupled through a handle tie 15. That is, due to the mechanical linkages operatively coupling the operating mechanisms 14 of the adjacent circuit breakers 11 and the coupled configuration of all of the handles 17, if the operating mechanism 14 of one circuit breaker 11 moves from the closed configuration to the open configuration, the operating mechanisms 14 of the other two circuit breakers 11 also simultaneously move from the closed configuration to the open configuration.

Throughout the present disclosure, reference is made to the "associated circuit breaker 11" with respect to the shunt trip assembly 20, the associated circuit breaker 11 being the circuit breaker 11 immediately adjacent to the shunt assembly 20. The effects of the shunt trip assembly 20 are described with respect to the operating mechanism 14 of the associated circuit breaker 11 (as opposed to all of the operating mechanisms 14 for all of the circuit breakers 11 in the circuit breaker installation 10) for economy of disclosure. However, it will be appreciated that, due the coupling of all of the operating mechanisms 14 of all of the circuit breakers 11 in the circuit breaker installation 10, the operating mechanisms 14 of all of the circuit breakers 11 are actuated in the same manner as the operating mechanism 14 of the associated circuit breaker 11 by the shunt trip assembly 20.

The shunt trip assembly 20 includes a shunt housing 30 comprising an exterior sidewall 38, a top wall 34, and a front wall 36, as well as a bottom wall and a back wall that are obscured in the view shown in FIG. 1A, the bottom wall being substantially parallel to the plane of the top cover 34 and the back wall being substantially parallel to the plane of front wall 36. When coupled together, the exterior sidewall 38, top wall 34, front wall 36, bottom wall, and back wall form a shunt base 331. FIG. 1B shows the shunt trip assembly 20 with the shunt housing 30 removed, such that a lateral sidewall 40 of the circuit breaker 11 adjacent to the shunt trip assembly 20 can be viewed. The lateral sidewall 40 is the particular sidewall 13 of the adjacent circuit breaker 11 to which the shunt base 331 is coupled in order to enclose the components of the shunt trip assembly 20. The design of the shunt housing 30 shown in FIGS. 1A and 1B is referred to as a single housing design (the shunt base 331 being the single housing), in contrast to a double housing design, which is described in more detail with respect to FIGS. 1C-1D, below. Further description of the shunt trip assembly 20 is provided in association with FIGS. 3, 5, and 7.

Figure 1C:
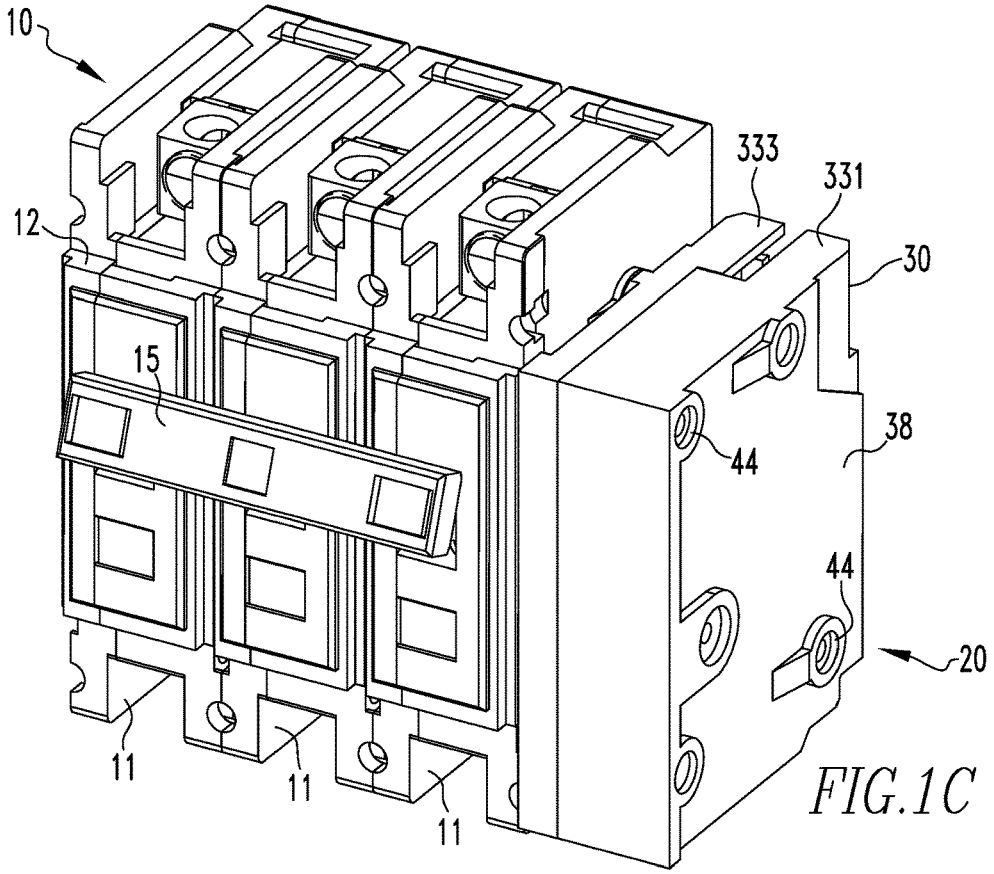
FIG. 1C is an isometric view of a circuit breaker installation including a lever-based shunt trip assembly with a double housing shunt housing design, in accordance with an exemplary embodiment of the disclosed concept.
Figure 1D:
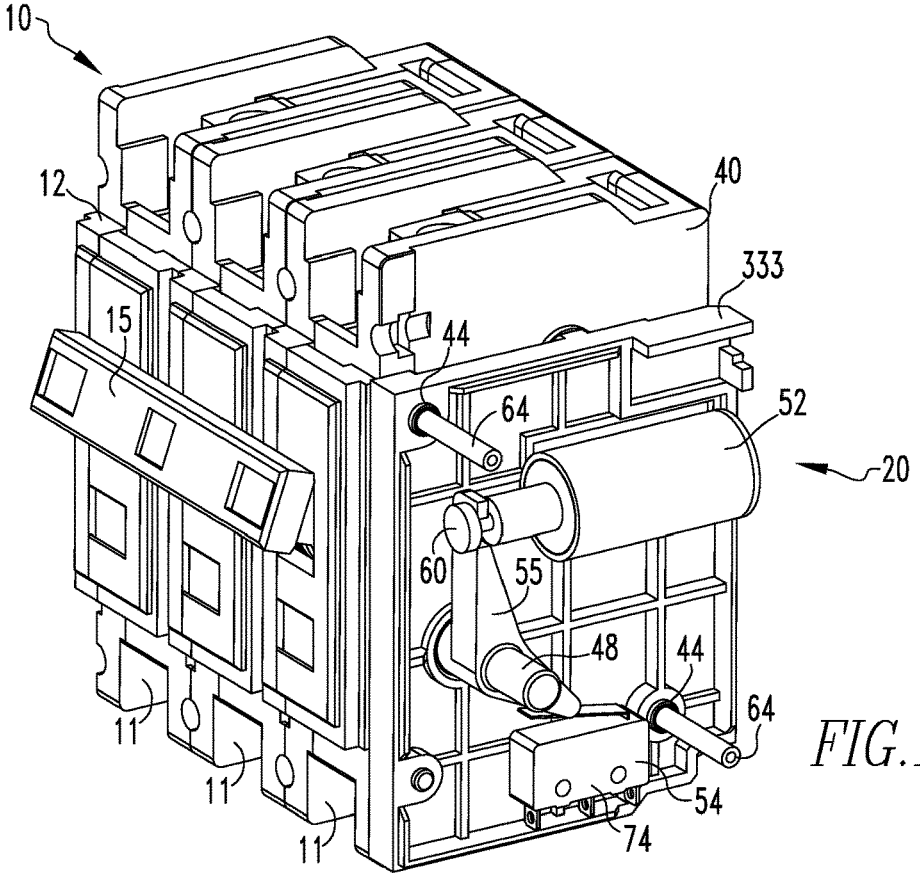
FIG. 1D is an isometric view of the circuit breaker installation shown in FIG. 1C with the base of the double housing for the shunt trip assembly removed and a single bay solenoid included in the shunt trip assembly.

Referring to FIGS. 1C and 1D, a circuit breaker installation 10 includes three circuit breakers 11 and a lever-based shunt trip assembly 20 as the circuit breaker installation 10 shown in FIGS. 1A and 1B do, but the shunt housing 30 of the shunt trip assembly 20 is a double housing assembly, wherein the shunt housing 30 comprises a shunt cover 333 in addition to the shunt base 331 of the single housing design shown in FIGS. 1A and 1B. As shown in FIG. 1C, the shunt cover 333 of the double housing design is coupled to the lateral sidewall 40 of the adjacent circuit breaker 11, and the shunt base 331 is coupled to the shunt cover 333 so as to enclose the other components of the shunt trip assembly 20. FIG. 1D shows the shunt trip assembly 20 with the shunt base 331 removed, and a single bay solenoid 52, as opposed to the double bay solenoid 52 shown in FIG. 1B. In order to clearly show that the solenoid 52 shown in FIG. 1D is a single bay solenoid, the solenoid 52 is shown in FIG. 1D without being mounted in a solenoid frame 47, however, the single bay solenoid 52 is mounted in a frame in the complete setup of the shunt trip assembly 20, as shown in FIGS. 3, 5, 7, 11A and 11B. It will be appreciated that a single bay solenoid 52 such as that shown in FIG. 1D could be included in a shunt trip assembly 20 with a single housing such as that shown in FIG. 1B, and that a double bay solenoid 52 such as that shown in FIG. 1B could be included in a shunt trip assembly 20 with a double housing such as that shown in FIG. 1D, without departing from the scope of the disclosed concept. The functioning of the solenoid 52 is described in more detail with respect to FIGS. 11A and 11B herein, and a comparison of the single bay and double bay designs of the solenoid 52 is provided between a description of FIG. 15 and a description FIG. 16 herein.

As used hereinafter, the term "single housing" used in relation to the shunt trip assembly 20 denotes that the shunt housing 30 comprises a shunt base 331, and that the shunt base 331 is coupled directly to the lateral sidewall 40 of the adjacent circuit breaker 11 to enclose the other components of the shunt trip assembly 20 as shown in FIG. 1A. Accordingly, as used hereinafter, the term "double housing" used in relation to the shunt trip assembly 20 denotes that the shunt housing 30 comprises both a shunt base 331 and a shunt cover 333, with the shunt cover 333 being coupled to the lateral sidewall 40 of the adjacent circuit breaker 11 and the shunt base 331 being coupled to the shunt cover 333 to enclose the other components of the shunt trip assembly 20 as shown in FIG. 1C. The dimensions of a shunt trip housing 30 are often substantially the same as the dimensions of the associated circuit breaker housings 12, and in one non-limiting example, a double housing assembly for a shunt trip assembly 20 may be used in a circuit breaker installation 10 with 1-inch wide circuit breakers 11 while a single housing assembly may be used in a circuit breaker installation 10 with ¾-inch wide circuit breakers 11.

Figure 2:
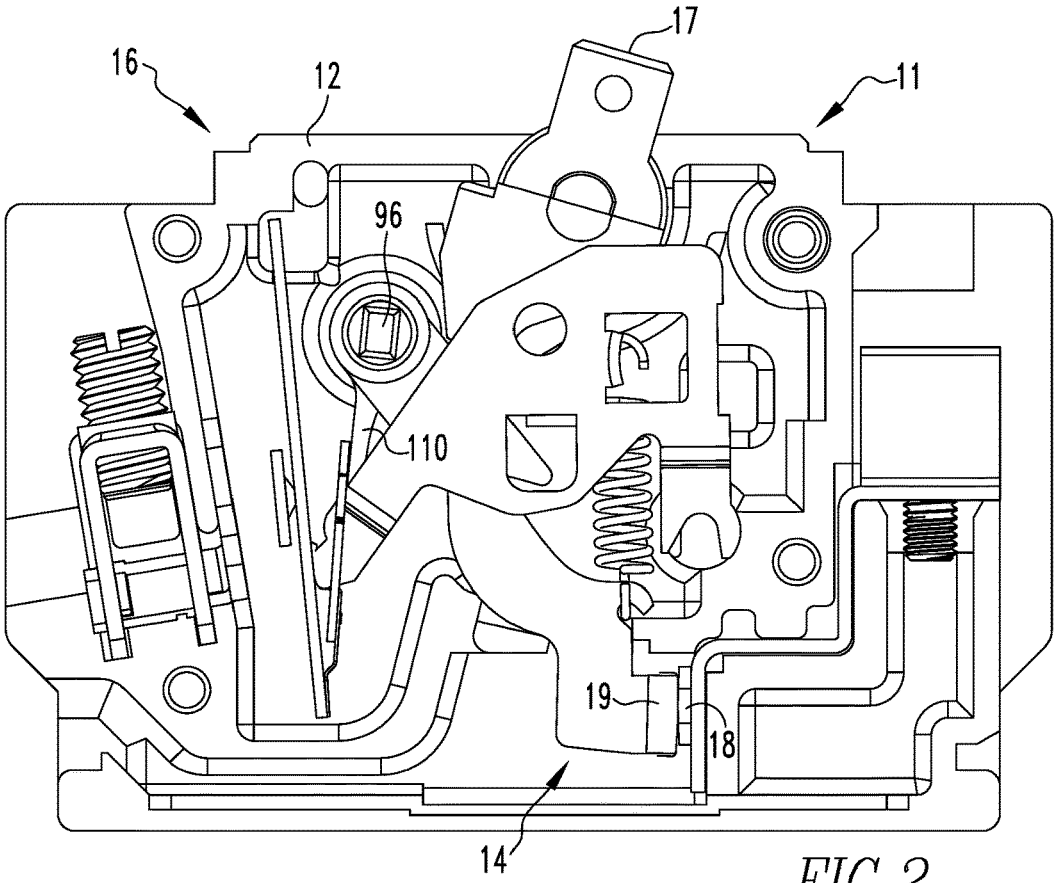
FIG. 2 is a side view of a circuit breaker shown in FIGS. 1A-1D disposed in an ON state with the breaker sidewall removed.
Figure 4:
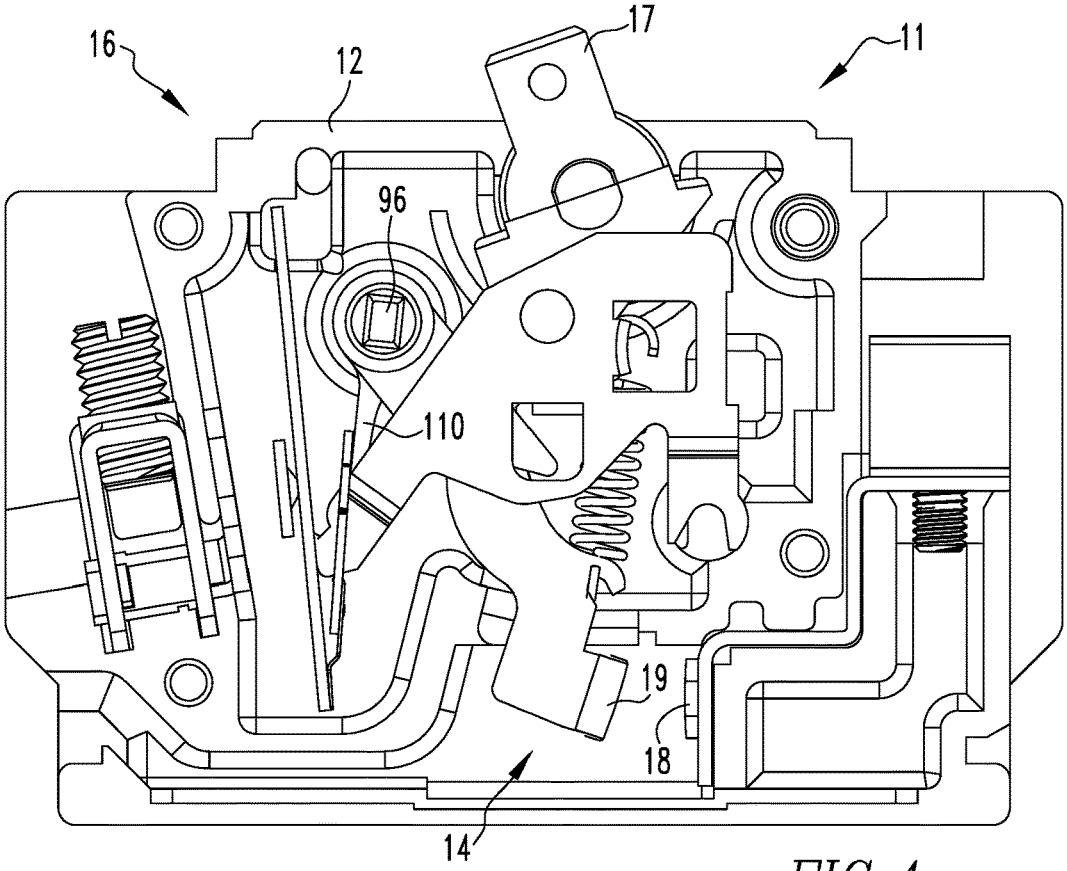
FIG. 4 is a side view of a circuit breaker shown in FIGS. 1A-1D disposed in an OFF state with the breaker sidewall removed.
Figure 6:
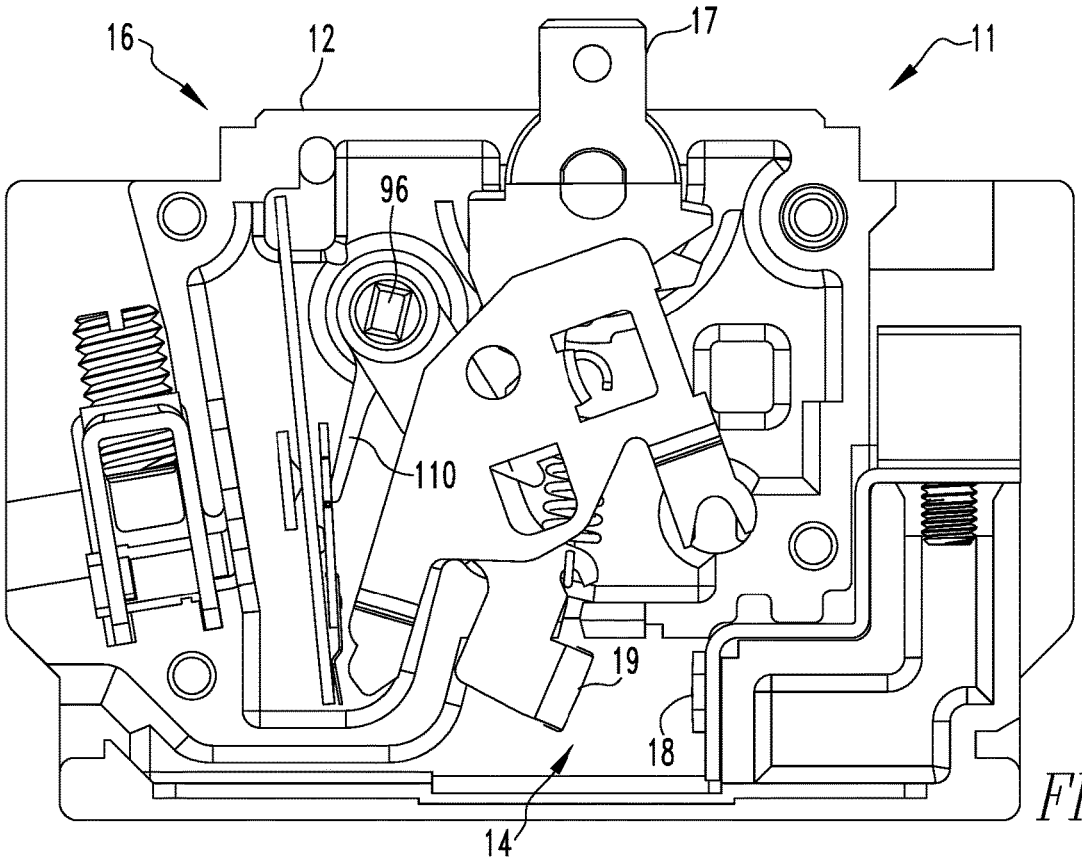
FIG. 6 is a side view of a circuit breaker shown in FIGS. 1A and 1B disposed in a TRIP state with the breaker sidewall removed.

FIGS. 2, 4, and 6 show one of the circuit breakers 11 shown in FIGS. 1A-1D with the sidewall 13 removed. As shown in FIGS. 2, 4, and 6, each of the circuit breakers 11 includes a housing 12, an operating mechanism 14 including a handle 17, a pair of separable contacts including one fixed contact 18 and one movable contact 19, and a trip assembly 16. In each circuit breaker 11, the operating mechanism 14 is operatively coupled to the movable contact 19 and structured to move the movable contact 19 between a closed position (wherein the movable contact 19 is in electrical communication with the fixed contact 18, as shown in FIG. 2), and an open position (wherein the movable contact 19 is not in electrical communication with the fixed contact 18, as shown in FIGS. 4 and 6). The operating mechanism 14 is disposed in the open configuration following either a manual opening (FIG. 4) or a trip (FIG. 6), the trip being due to either an automatic actuation by the trip assembly 16 upon detection of a trip condition or a remote actuation of the shunt trip assembly 20.

Figure 3:
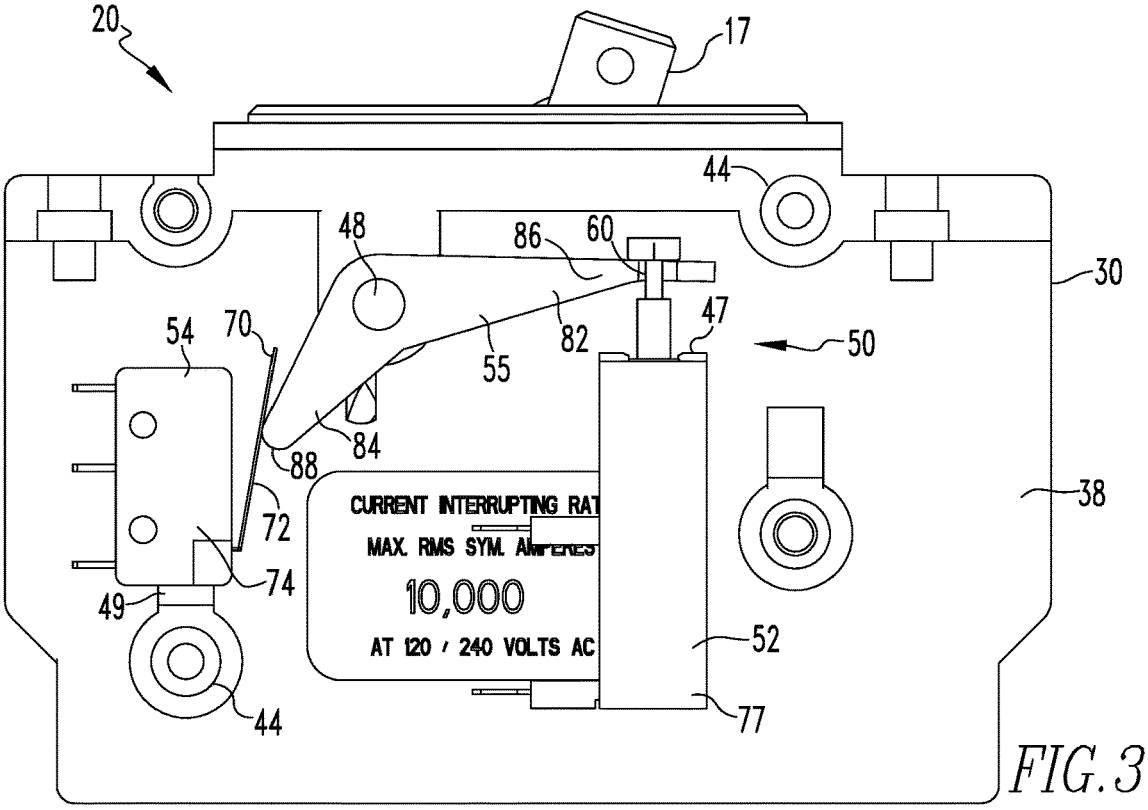
FIG. 3 is a side view of either of the shunt trip assemblies shown in FIG. 1B and FIG. 1D that shows a non-actuated disposition of the shunt trip assembly when the circuit breaker is disposed in an ON state as shown in FIG. 2.
Figure 5:
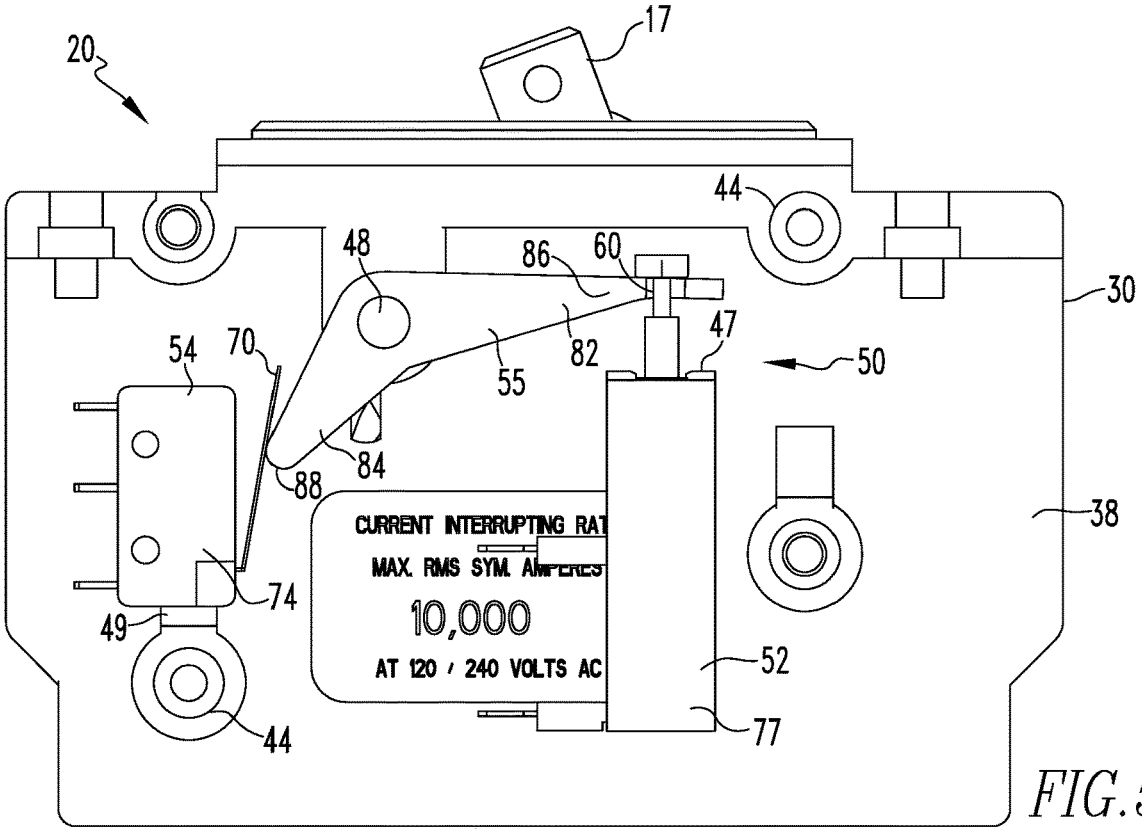
FIG. 5 is a side view of either of the shunt trip assemblies shown in FIG. 1B and FIG. 1D that shows a non-actuated disposition of the shunt trip assembly when the circuit breaker is disposed in an OFF state as shown in FIG. 4.
Figure 7:
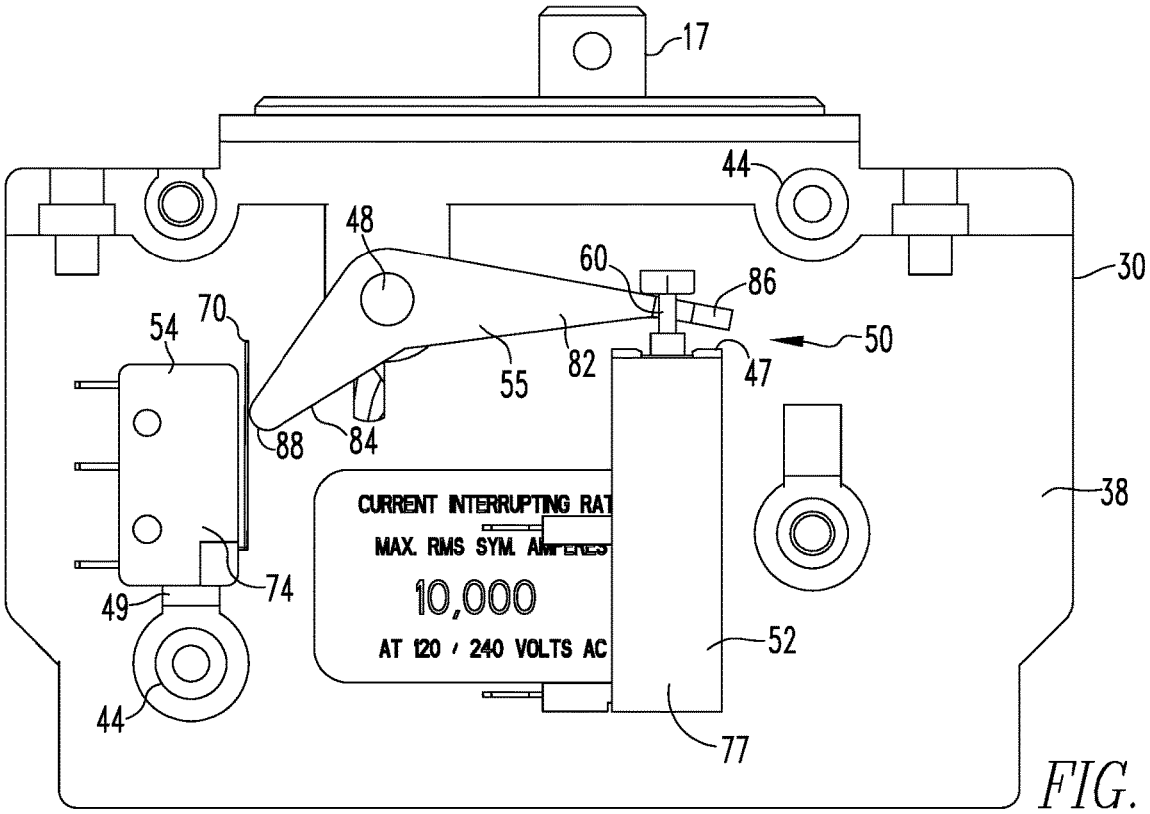
FIG. 7 is a side view of either of the shunt trip assemblies shown in FIG. 1B and FIG. 1D that shows an actuated disposition of the shunt trip assembly when the circuit breaker is disposed in a TRIP state as shown in FIG. 6.

FIG. 2 shows the circuit breaker 11 operating in an ON state wherein the separable contacts 18, 19 are closed and wherein the handle 17 of the circuit breaker is disposed in a righthand position, relative to the view shown in FIG. 2. FIG. 3 shows the corresponding disposition of the shunt trip assembly 20 when the separable contacts 18, 19 of the circuit breakers 11 are closed as shown in FIG. 2, in accordance with an exemplary embodiment of the disclosed concept. FIG. 4 shows the circuit breaker 11 in an OFF state wherein the separable contacts 18, 19 have been manually opened via the handle 17 and wherein the handle 17 is disposed in a lefthand position, relative to the view shown in FIG. 4. FIG. 5 shows the corresponding disposition of the shunt trip assembly 20 when the separable contacts 18, 19 of the circuit breakers 11 have been manually opened as shown in FIG. 4, in accordance with an exemplary embodiment of the disclosed concept. FIG. 6 shows the circuit breaker 11 in a TRIP state wherein the separable contacts 18, 19 are open due to either detection of an overcurrent condition by the trip assembly 16 or to operation of the shunt trip assembly 20, and wherein the handle 17 is disposed in a middle position, the middle position being relative to the righthand and lefthand positions shown in FIGS. 2 and 4. For the purposes of the present disclosure, it is assumed that the TRIP state shown in FIG. 6 is due to operation of the shunt trip assembly 20. The shunt trip assembly 20 actuates opening of the circuit breaker separable contacts 18, 19 via a coupling between the shunt trip assembly 20 to a trip cam 110 of the circuit breaker 11, as described in more detail with respect to FIGS. 8 and 9 herein. FIG. 7 shows the corresponding disposition of the shunt trip assembly 20 when the separable contacts 18, 19 of the circuit breakers 11 have been tripped open as shown in FIG. 6, in accordance with an exemplary embodiment of the disclosed concept.

It should be noted that the operating mechanism 14 included in the circuit breaker 11 depicted in FIGS. 2, 4, and 6 is a tri-stable mechanism, due to the three states (ON, OFF, TRIP) in which the operating mechanism 14 and the handle 17 can be disposed. An alternative to the tri-stable mechanism is a bi-stable mechanism, which can only be disposed in two states, ON and OFF, such that the operating mechanism 14 and the handle 17 will move to the OFF position when a trip occurs. The inclusion of a tri-stable mechanism in the figures as opposed to a bi-stable mechanism is used for illustrative purposes only and is not intended to be limiting on the scope of the disclosed concept.

Referring to FIGS. 3, 5, and 7, an actuating assembly 50 of the shunt trip assembly 20 comprises a solenoid 52, a plunger 60 coupled to the solenoid 52, a micro switch 54, and a lever member 55, in accordance with an exemplary embodiment of the disclosed concept. The exterior sidewall 38 (also shown in FIGS. 1A and 1C) acts as a mounting panel to which the components of the actuating assembly 50 are coupled. In particular, the solenoid 52 is coupled to the exterior sidewall 38 via a solenoid frame 47, the micro switch 54 is coupled to the exterior sidewall 38 via a micro switch mounting 49, and the lever member 55 is coupled at its fulcrum to the exterior sidewall 38 via a an axle 48 that protrudes from the exterior sidewall 38 into the interior of the shunt trip assembly 20 such that the lever member 55 can rotate about the lever axle 48 when force is exerted on the lever member 55. It should be noted that the perspective of the view shown in FIGS. 3, 5, and 7 is one in which the viewer is viewing a solenoid mounting surface 77 of the solenoid frame 47 (as also shown in FIG. 1B) and a switch mounting surface 74 of the micro switch mounting 49 (as also shown in FIGS. 1B and 1D) head on, as if looking through the exterior sidewall 38 and toward the adjacent circuit breaker 11. These components may be more clearly viewed in FIGS. 8, 9, and 10.

Figure 8:
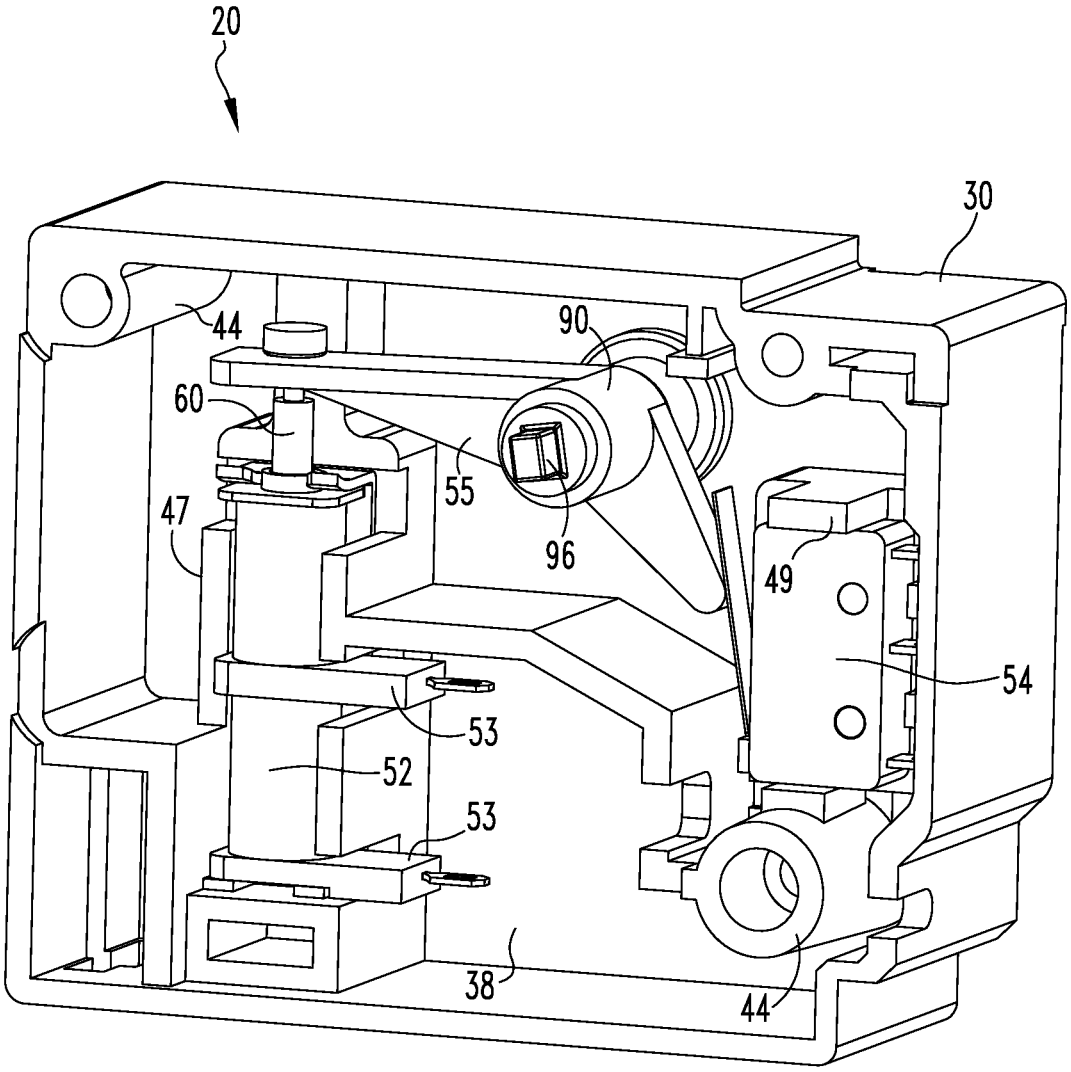
FIG. 8 shows an isometric view of the single housing, double bay solenoid shunt trip assembly shown in FIG. 1B.
Figure 9:
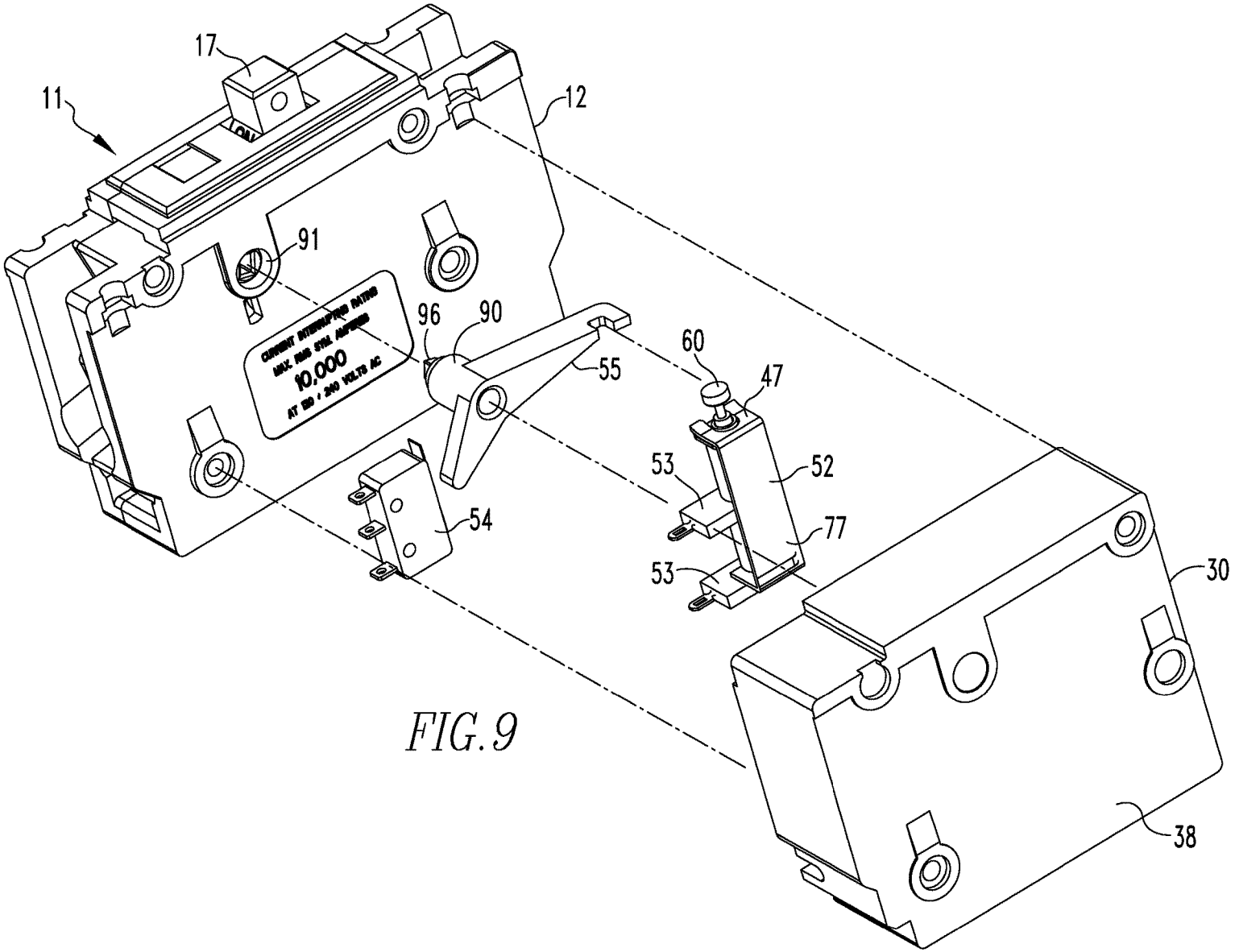
FIG. 9 shows an exploded view of the single housing, double bay solenoid shunt trip assembly shown in FIG. 1B.
Figure 10:
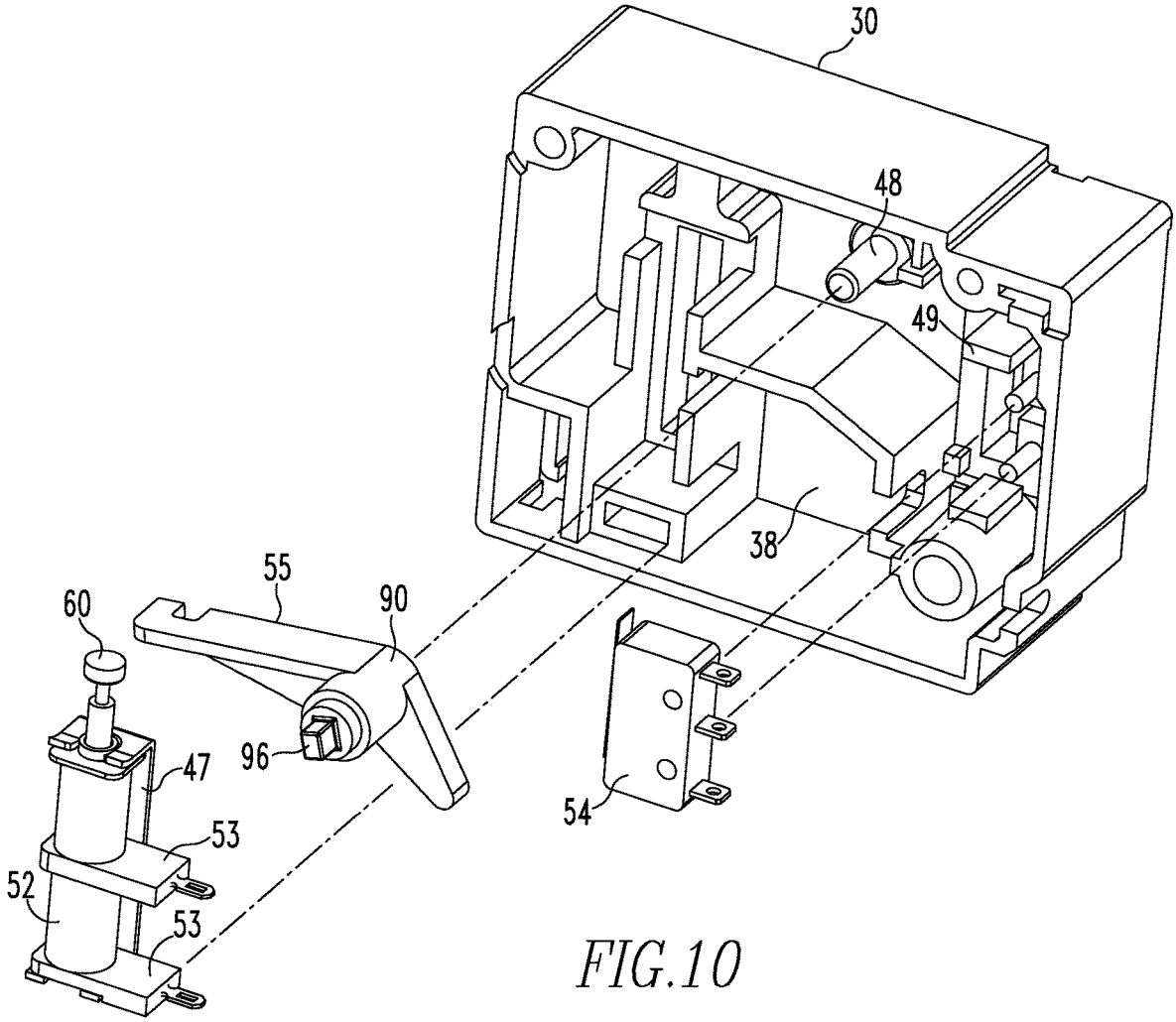
FIG. 10 shows an alternative exploded view of the single housing, double bay solenoid shunt trip assembly shown in FIG. 1B.

FIG. 8 shows an isometric view of the shunt trip assembly 20, while FIG. 9 and FIG. 10 each show alternative exploded views of the shunt trip assembly 20. The solenoid 52 shown in FIGS. 8, 9, and 10 is a double bay design such as the one shown in FIG. 1B, and, as previously noted with respect to FIG. 1D, a comparison of the single bay and double bay designs of the solenoid 52 is provided between a description of FIG. 15 and a description FIG. 16 herein. As shown in FIGS. 8, 9, and 10, the lever member 55 further comprises a rotational coupling member 90 which is rotationally coupled to the axle 48, and the rotational coupling member 90 includes a fastener 96 at a first end of the rotational coupling member 90. Referring to FIG. 9, the fastener 96 extends through a lateral sidewall passage 91 of the associated circuit breaker 11 and is operatively coupled to a trip cam 110 (shown in FIGS. 2, 4, and 6) of the associated circuit breaker 11 that is coupled to the operating mechanism 14 of the circuit breaker 11. Accordingly, the lever member 55 is operatively coupled to the operating mechanism 14 of the associated circuit breaker 11 and rotation of the lever member 55 causes the trip cam 110 to rotate and actuate the operating mechanism 14 to open the separable contacts 18, 19. When the shunt trip assembly 20 is powered on to trip the circuit breaker 11, the solenoid 52, micro switch 54, and lever member 55 operate in conjunction to actuate the circuit breaker operating mechanism 14 by rotating the rotational coupling member 90, as described in more detail with respect to FIGS. 11A and 11B below.

Figure 11A:
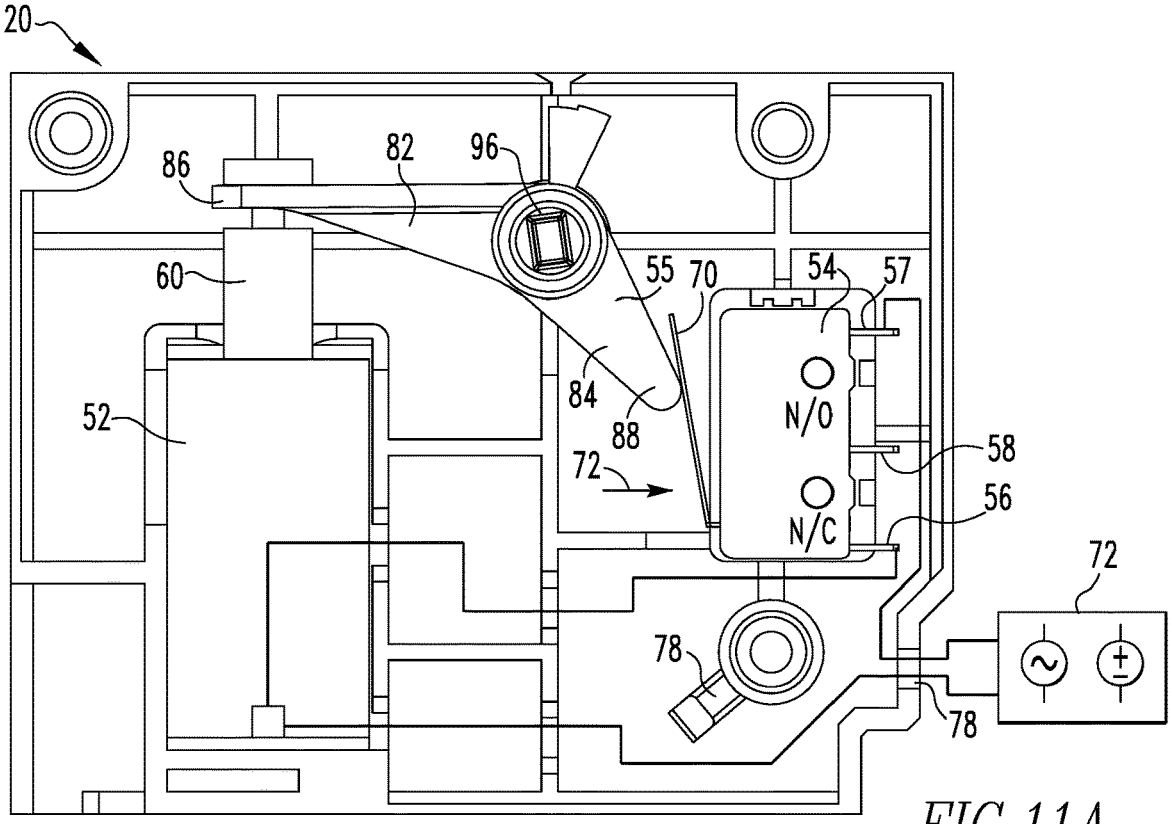
FIG. 11A is a simplified view of the single bay solenoid shunt trip assembly shown in FIG. 1D showing electrical connections between the components of the shunt trip assembly and showing the components prior to actuation, in accordance with an exemplary embodiment of the disclosed concept.
Figure 11B:
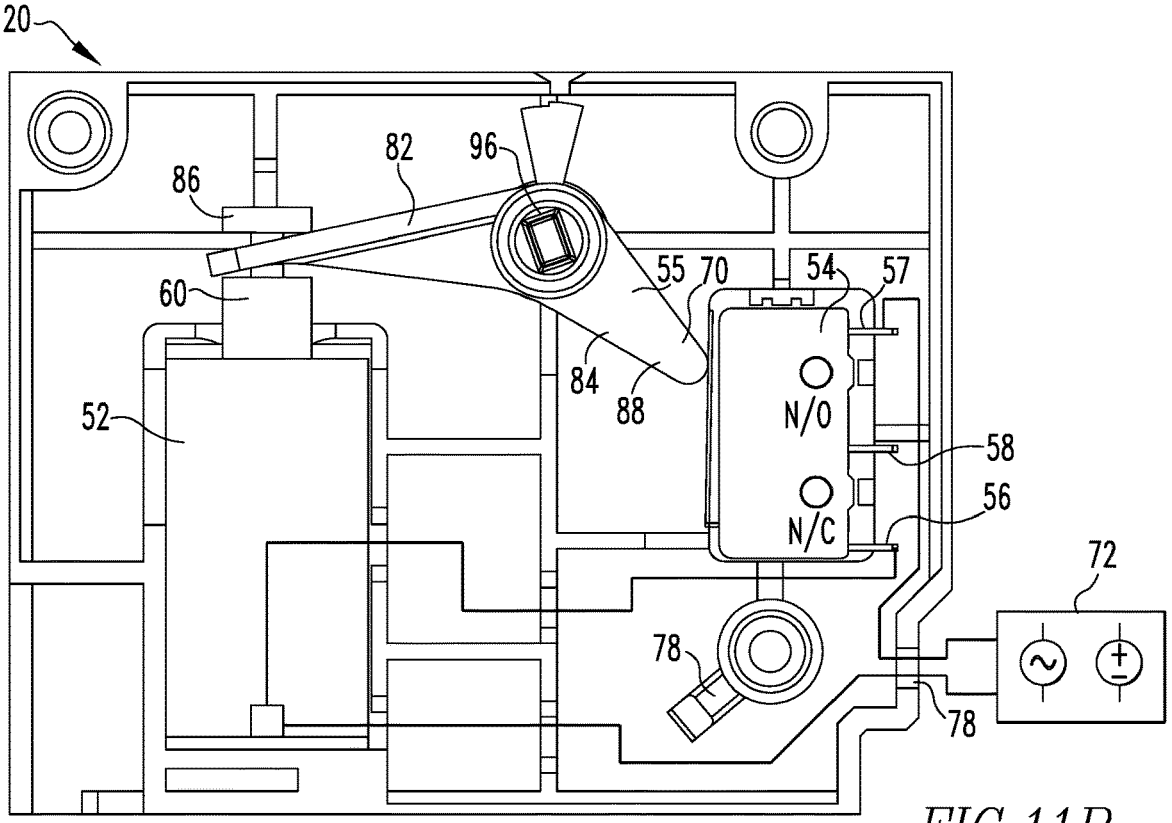
FIG. 11B is a simplified view of the single bay solenoid shunt trip assembly shown in FIG. 1D showing electrical connections between the components of the shunt trip assembly and showing the components after actuation, in accordance with an exemplary embodiment of the disclosed concept.

FIGS. 11A and 11B show a simplified representation of the shunt trip assembly 20 and the electrical connections (the wires not being numbered) between the terminals 56, 57, 58 of the micro switch 54 and the solenoid 52 needed to make the shunt trip assembly 20 function, in accordance with an exemplary embodiment of the disclosed concept. As shown in FIGS. 11A and 11B, a number of wire routing features 78 can be included in the shunt housing 30 to ensure that the electrical wires can withstand any pulling forces. Referring to FIG. 11A, during normal operation of the circuit breaker 11, the shunt trip assembly 20 is in an OFF state such that no current flows through the micro switch 54 to the solenoid 52. Referring to FIG. 11B, the shunt trip assembly 20 only gets powered ON to actuate the circuit breaker operating mechanism 14 when a user selectively turns on a secondary power source 72 configured to provide power to the micro switch 54. The micro switch 54 is powered separately by the secondary power source, i.e. the secondary power source does not supply power to the circuit breakers 11. Hereinafter, the secondary power source 72 is referred to as the "shunt supply voltage source". The shunt supply voltage source 72 can supply either 50/60 HZ AC power or DC power without departing from the scope of the disclosed concept.

Still referring to FIGS. 11A and 11B, micro switches such as micro switch 54 typically include a housing, a normally closed (N/C) terminal, a normally open (N/O) terminal, a common terminal, an internal switch disposed inside of the housing, and an arm disposed substantially outside of the housing and partly inside the housing. Terminal 56 is a N/C terminal, terminal 57 is a common terminal, and terminal 58 is a N/O terminal. The internal switch (not visible in FIGS. 11A and 11B) of micro switch 54 has one fixed contact and one moving contact disposed inside the housing. The fixed contact is always electrically connected to the common terminal 57 and is additionally mechanically coupled to the section of the arm 70 disposed inside the housing, while the moving contact is structured to move between the N/C and N/O terminals 56, 58. When the micro switch arm 70 is disposed in a default resting position as shown in FIG. 11A, the moving contact of the internal switch rests against the N/C terminal 56 and is in electrical contact with the N/C terminal 56 such that, if a power source is electrically connected to the common terminal 57, the N/C terminal 56 can provide power to a load electrically connected to the N/C terminal 56, i.e. the solenoid 52. The disposition of the micro switch 54 shown in FIG. 11A is hereinafter referred to as the "closed state". The N/O terminal 58 is not electrically connected to the common terminal 57 when the micro switch 54 is disposed in the closed state. When the arm 70 is pushed in the direction indicated by arrow 72 in FIG. 11A to reach the position shown in FIG. 11B, the arm 70 pushes the moving contact of the internal switch to rest against the N/O terminal 58 so as to put the common terminal 57 in electrical contact with the N/O terminal 58 instead of the N/C terminal 56, thereby cutting off power to the N/C terminal 56 and to the solenoid 52. The disposition of the micro switch 54 shown in FIG. 11B is hereinafter referred to as the "open state". The N/C terminal 56 is not electrically connected to the common terminal 57 when the micro switch 54 is disposed in the open state. Furthermore, if the arm 70 is moved from the open state to the closed state, the moving contact of the internal switch will separate from the N/O terminal 58 so as to be in electrical contact with the N/C terminal 56. It should be noted that the lever member 55 is not operatively engaged with the micro switch 54 in FIG. 11A, and is operatively engaged with the micro switch 54 in FIG. 11B.

Referring to FIG. 16, the solenoid 52 is an electromagnet that comprises a coil 63 of conductive wire wound around a bobbin 65 and a ferromagnetic housing 61 that contains the coil 63 and the bobbin 65. The plunger 60 is produced from ferromagnetic material and is coupled to the solenoid 52 so as to be movably disposed within the solenoid housing and the coil 63. Referring now to FIG. 11A, when the shunt trip assembly is in an OFF state, the plunger 60 is disposed substantially outside of the solenoid housing 61 as shown in FIG. 11A. When power is provided to the solenoid 52, current flows through the solenoid coil 63 and generates a magnetic field and associated electromagnetic forces that pull the plunger 60 downward (relative to the view shown in FIGS. 11A and 11B) so as to be disposed substantially inside of the solenoid housing 61, as shown in FIG. 11B. The movement of the plunger 60 between its position as shown in FIG. 11A and its position as shown in FIG. 11B may be referred to hereinafter as the "plunger stroke" or the "stroke".

The lever member 55 comprises a first arm, a long arm 82, that is substantially disposed between the fulcrum of the lever member 55 (i.e. the region of the lever member 55 coupled to the axle 48) and the plunger 60, and a second arm, a short arm 84, that is substantially disposed between the fulcrum and the micro switch arm 54. The short arm 84 is shorter than the long arm 82. The long arm 82 comprises a first end of the lever member 55 that is coupled to the plunger 60, a plunger end 86, while the short arm 84 comprises a second end of the lever member 55 that is disposed against the micro switch arm 70, a switch end 88, disposed opposite the first end (i.e. the plunger end 86). The shunt supply voltage source 72 electrically connected to the micro switch 54 is powered off except when use of shunt trip assembly 20 is desired, and the shunt trip assembly 20 is disposed in the state shown in FIG. 11A (as well as FIG. 4) when the shunt trip assembly 20 is not energized by the shunt supply voltage source 72.

When the circuit breakers 11 are operating normally in an ON state as shown in FIG. 3 and remote tripping of the circuit breakers 11 using the shunt trip assembly 20 is desired, a user powers the shunt supply voltage source 72 on to provide power to the micro switch 54. The shunt trip assembly 20 is disposed as shown in FIGS. 4 and 11A when the circuit breakers 11 are operating in the ON state as shown in FIG. 3. When the shunt supply voltage source 72 is powered on, the common terminal 57 and the N/C terminal 56 of the micro switch are electrically connected as previously described. As shown in FIG. 11A, the solenoid 52 is electrically connected to the N/C terminal 56 and becomes energized with the current supplied from the shunt supply voltage source 72. When the solenoid 52 is energized with current, electromagnetic forces are generated and pull the plunger 60 further downward (relative to the view shown in FIG. 11A) into the solenoid housing. Because the lever member 55 is coupled at its plunger end 86 to the plunger 60 and coupled at its fulcrum via the rotational coupling member 90 and fastener 96 to the operating mechanism 14 of the adjacent circuit breaker 11, rotating the lever member 55 from the position shown in FIG. 11A toward the position shown in FIG. 11B causes the operating mechanism 14 of the adjacent circuit breaker 11 to open the separable contacts 18, 19.

In addition to causing the operating mechanism 14 of the adjacent circuit breaker 11 to open the separable contacts 18, 19, the rotation of the lever member 55 from the position shown in FIG. 11A to the position shown in FIG. 11B also causes the short arm 84 of the lever member 55 to push the micro switch arm 70 in the direction indicated by arrow 72 in FIG. 11A. Pushing the micro switch arm 70 in the direction of arrow 72 switches the micro switch 54 from the closed state to the open state and cuts off the current being supplied to the solenoid 52 by the shunt supply voltage source 72. This self-disconnect design of the shunt actuating assembly 50 with respect to the micro switch 54 prevents the solenoid 52 from receiving a continuous current and burning out, as the shunt trip assembly 20 is able to interrupt the current to the solenoid 52 in approximately 33 milliseconds or less.

Figure 12A:
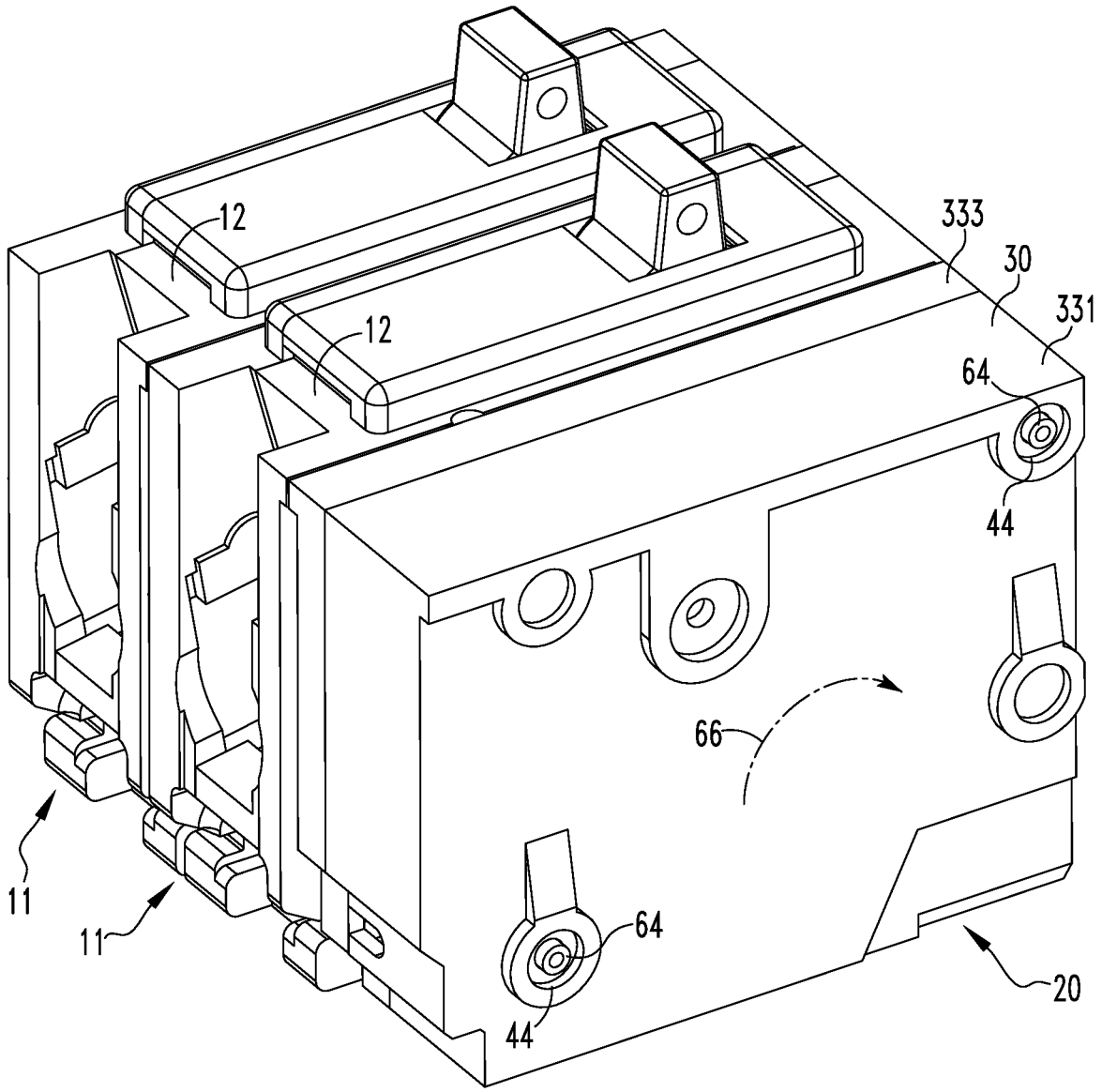
FIG. 12A shows an isometric view of the housings of a number of circuit breakers and the double housing of a shunt trip assembly shown in FIG. 1C mechanically coupled by rivets.

As the circuit breaker installation 10 is being assembled during the production process, the shunt trip assembly 20 can become misaligned relative to the associated circuit breakers 11. In addition, the rapid, forceful movements of the components in both the shunt trip assembly 20 and the associated circuit breaker 11 during a shunt trip can cause slight tilting of the shunt housing 30 and circuit breaker housing 12 relative to one another. Accordingly, in an exemplary embodiment of the disclosed concept, anti-tilt features are included in the shunt housing 30 to prevent tilting of the shunt trip assembly 20 relative to the associated circuit breakers 11 and maintain alignment during assembly and during shunt trips. Referring to FIG. 12A, a shunt trip assembly 20 with a double housing shunt housing 30 and a number of adjacent circuit breakers 11 (two are shown in FIG. 12A) can be coupled together using two diagonally disposed rivets 64 (also shown in FIG. 1D). The rivets are inserted through openings 44 (also shown in FIGS. 1A-1C, 3, 5, and 7) in the shunt housing 30 and corresponding openings in the adjacent circuit breaker housings 12. When a shunt trip occurs in the arrangement shown in FIG. 12A, slight rotation of the shunt housing 30 relative to the circuit breaker housing 12 occurs in a manner generally indicated by the arrow 66 due to the clearance between the circumference of the rivet and the circumference of the openings 44. Such rotation of the shunt housing 30 can lead to unwanted friction between the various internal components of the shunt trip assembly 20 and the circuit breakers 12 due to the misalignment that results from the rotation.

Figure 12B:
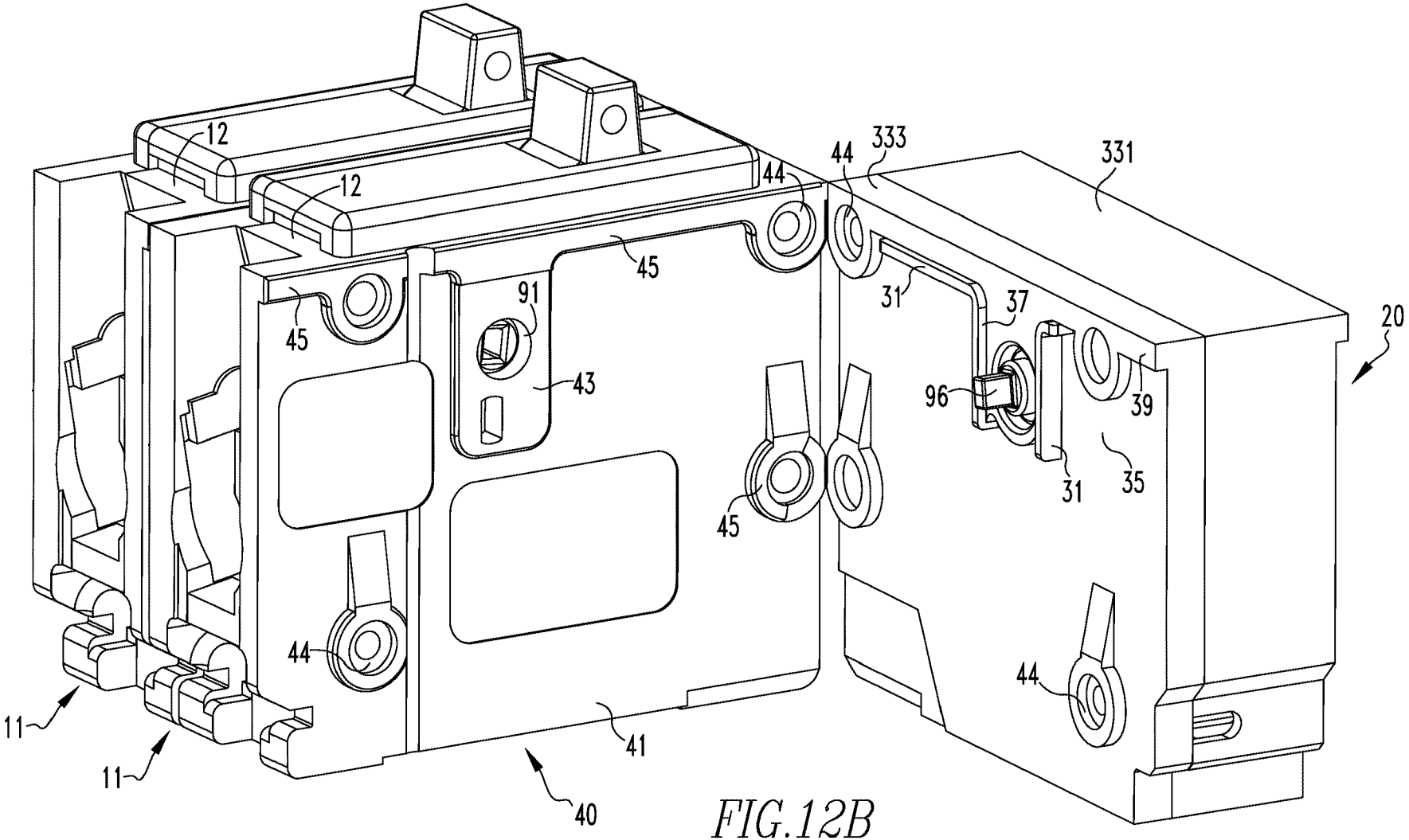
FIG. 12B shows an alternative isometric view of the number of the circuit breakers and shunt trip assembly shown in FIG. 12A wherein the surface of the shunt cover facing the circuit breakers in FIG. 12A can be viewed, showing anti-tilt features on the circuit breaker-facing surface of the shunt cover, in accordance with an exemplary embodiment of the disclosed concept.
Figure 12C:
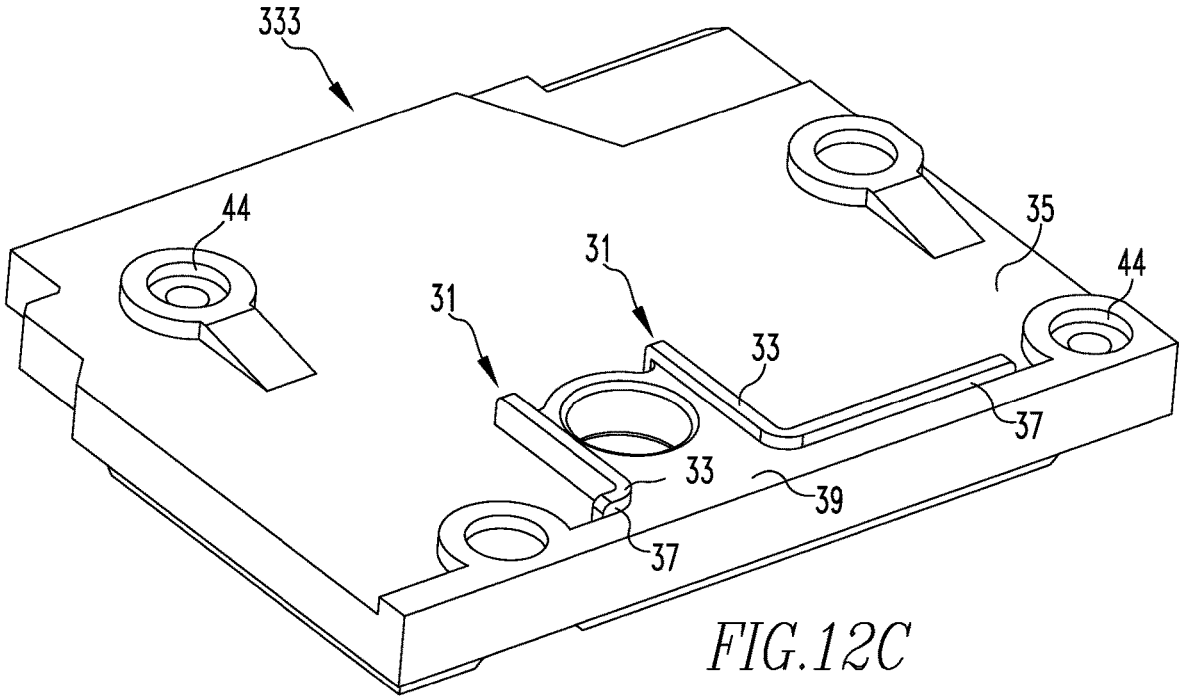
FIG. 12C shows an alternative isometric view of the shunt cover and anti-tilt features shown in FIG. 12B.
Figure 12D:
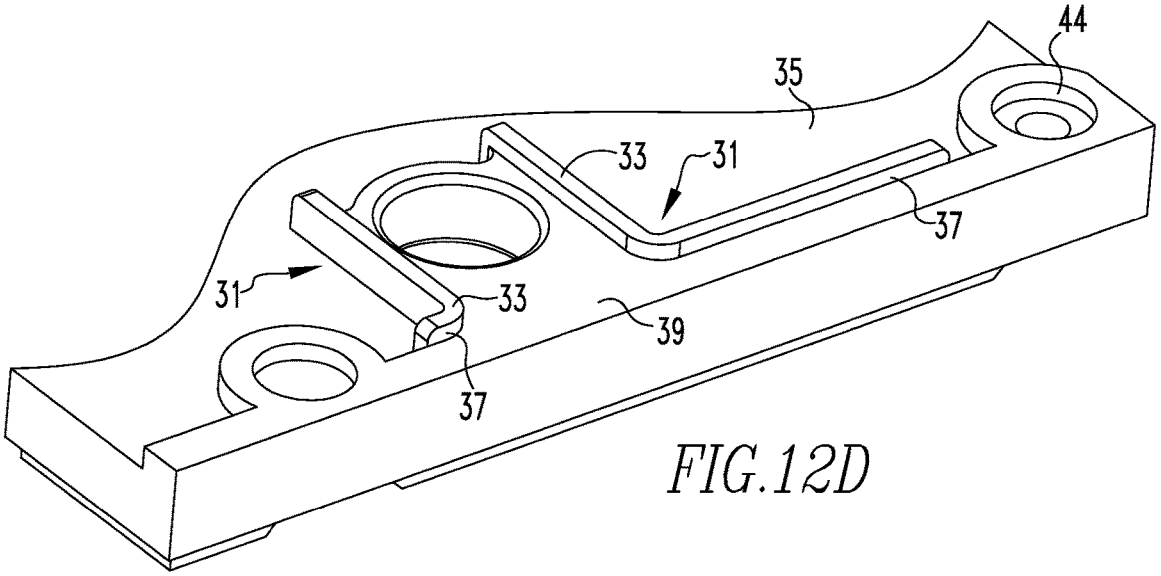
FIG. 12D shows an enlarged view of a portion of the shunt cover and anti tilt features shown in FIG. 12C.

Referring to FIGS. 12B-12D, in an exemplary embodiment of the disclosed concept, a number of anti-tilt inserts 31 can be included on the shunt cover 333 of the shunt trip housing 30. The anti-tilt inserts 31 may, for example and without limitation, be either integrally formed with the shunt cover 333 or produced separately from the shunt cover 333 and subsequently coupled to the shunt cover 333. FIG. 12B shows the shunt trip assembly 20 rotated relative to the arrangement shown in FIG. 12A such that the surface of the shunt cover 333 that faces the adjacent circuit breaker lateral sidewall 40 in FIG. 12A can be viewed, and such that the surface of the adjacent circuit breaker 11 lateral sidewall 40 that faces the shunt cover 333 in FIG. 12A can be viewed. FIG. 12C shows an isometric view of the shunt cover 333 that enables details of the anti-tilt inserts 31 to be more easily viewed than in FIG. 12B, and FIG. 12D shows an enlarged view of a portion of the shunt cover 333 shown in FIG. 12C that further enlarges details of the anti-tilt inserts 31.

Referring to FIGS. 12B-12D, a raised surface 39 of the shunt cover 333 is raised relative to a base surface 35 of the shunt cover 333. FIGS. 12C and 12D show that a circuit breaker-facing surface 33 of the anti-tilt inserts 31 is raised relative to the raised surface 39 of the shunt cover 333. A protrusion 37 is formed in each anti-tilt insert 31 by the region of the insert 31 disposed between the circuit breaker-facing surface 33 of the insert 31 and the raised surface 39 of the shunt cover 333. The protrusion 37 of each anti-tilt insert 31 is what prevents tilting of the shunt housing 30 during a shunt trip, as can be seen more clearly in FIG. 12E.

Figure 12E:
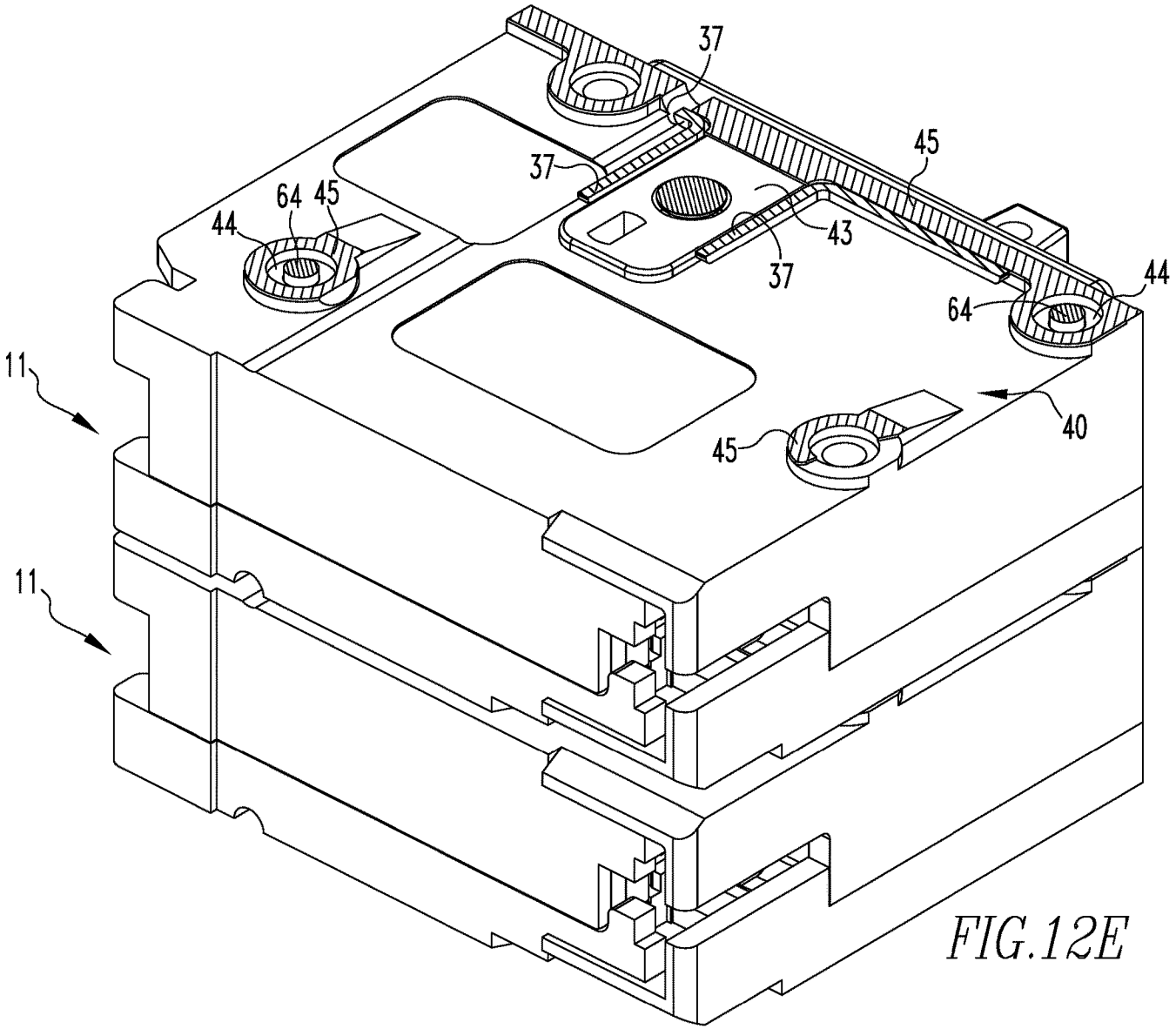
FIG. 12E shows an isometric view of the circuit breaker lateral sidewall adjacent to the shunt cover shown in FIG. 12B and how the anti-tilt features of the shunt cover interact with the circuit breaker lateral sidewall, in accordance with an exemplary embodiment of the disclosed concept.

FIG. 12E shows an isometric view of the two circuit breakers 11 shown in FIGS. 12A-12B such that the interaction between the anti-tilt inserts 31 and the circuit breaker lateral sidewall 40 adjacent to the shunt cover 333 can be viewed in detail. FIG. 12E shows that the lateral sidewall 40 comprises a base surface 41 and a raised surface 43. Both of the surfaces 41 and 43 face the shunt cover 333 in the view shown in FIG. 12A. As shown in FIG. 12E, the protrusion 37 of each anti-tilt insert 31 fits into a space created between the base surface 41 of the circuit breaker lateral sidewall 40 and the raised surface 43 of the circuit breaker lateral sidewall 40. It should be noted that the circuit breaker-facing surface 33 of the inserts 31 visible in FIG. 12D is disposed against the circuit breaker base surface 41 in FIG. 12E and thus is not visible in FIG. 12E. In addition, the diagonal shading used in regions 45 of FIG. 12E indicates the regions of lateral sidewall 40 that are slightly raised relative to the raised surface 43 and thus are in contact with the shunt cover 333 when the circuit breakers 11 and shunt trip assembly 20 are assembled as shown in FIG. 12A.

As shown in FIG. 12E, the protrusions 37 fit snugly within the depressions between the circuit breaker sidewall base surface 41 and raised surface 43, ensuring a mating of the shunt housing 30 and the circuit breaker housing 12 and preventing any tilting or misalignment of the shunt housing 30 that could otherwise occur during assembly or during a shunt trip. In addition, the anti-tilt inserts 31 assist in keeping the circuit breaker trip cam 110 opening coaxial with the shunt trip pole lever member 55 axis. It will be appreciated that the anti-tilt inserts 31 can be used in conjunction with the rivets 64 or can be excluded from the shunt housing altogether without departing from the scope of the disclosed concept.

Figure 13A:
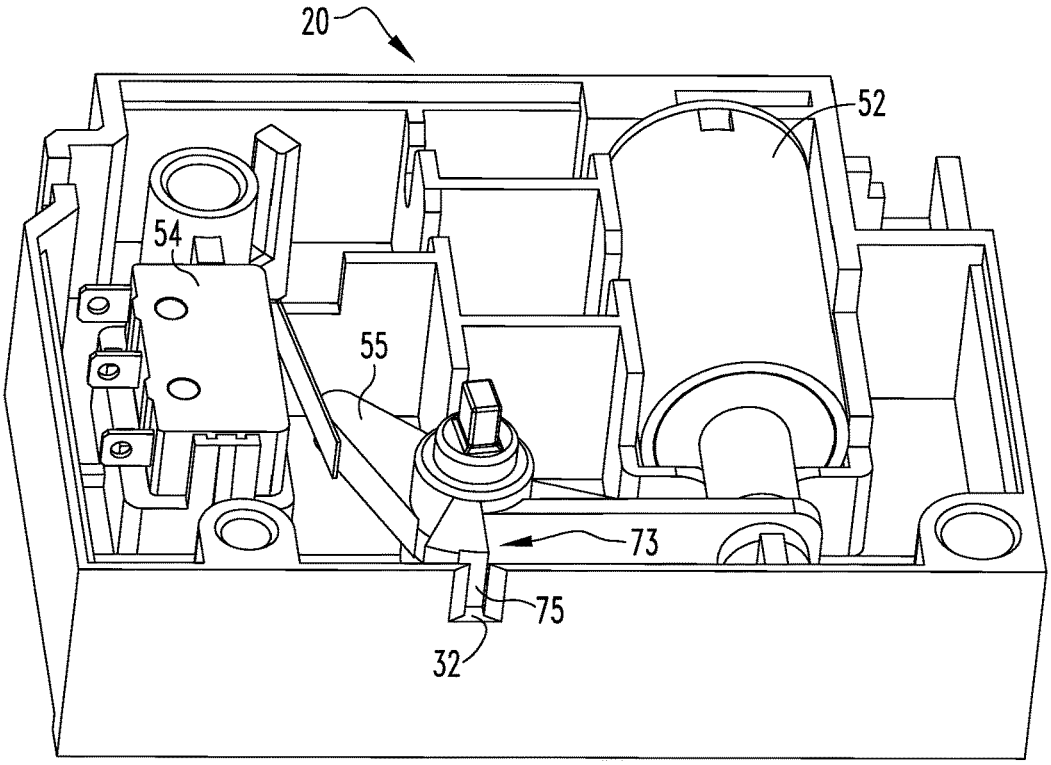
FIGS. 13A and 13B are perspective views of the shunt trip assembly shown in FIG. 1B with an optional shunt trip status indicator included on the shunt lever itself, in accordance with an exemplary embodiment of the disclosed concept.
Figure 13B:
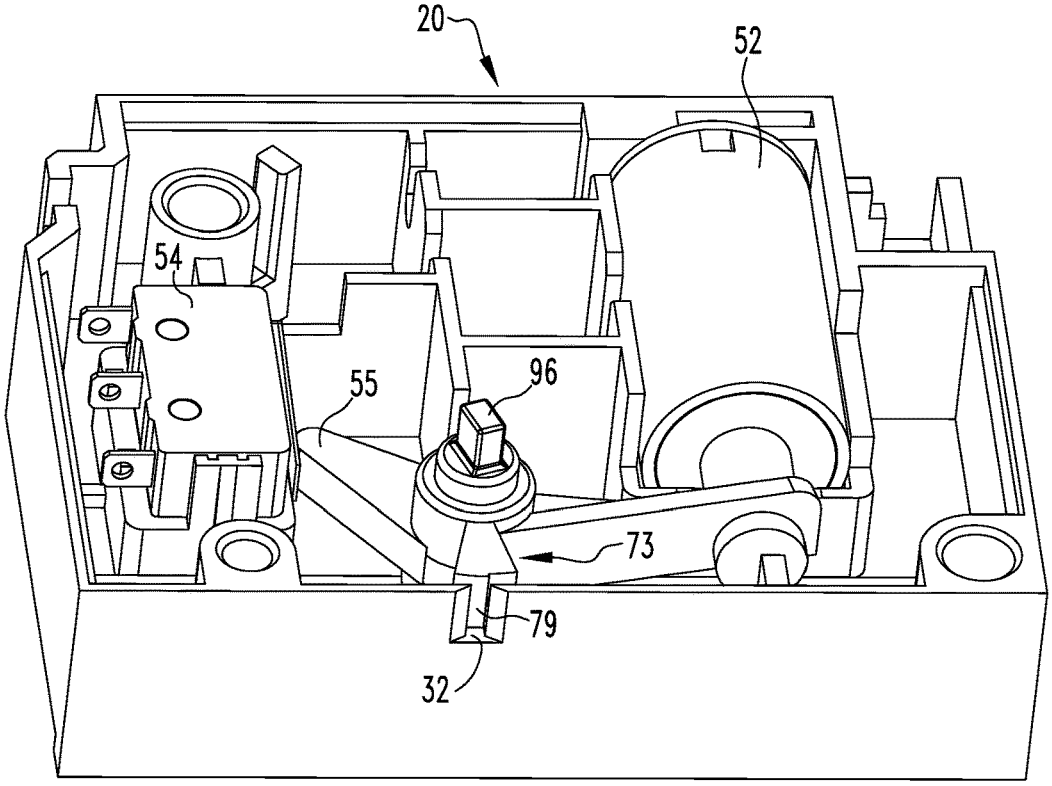

Referring to FIGS. 13A and 13B, in an exemplary embodiment, an optional shunt status indicator 73 can be included on a region of the lever member 55 visible from the exterior of the shunt housing 30 via an optional window 32 that can be included on the front wall 36 of the shunt housing 30 (the front wall 36 having previously been identified with respect to FIG. 1A). The visible region of the lever member 55 has two sections, a first section 75 visible through the window when the shunt trip assembly 20 is in an OFF state, i.e. when the lever member 55 is disposed as shown in FIG. 11A, and a second section 79 visible through the window after the shunt trip assembly 20 has tripped the associated circuit breaker 11 to open the separable contacts 18, 19, i.e. when the lever member 55 is disposed as shown in FIG. 11B. The first section 75 would display a first shunt status indication (see FIG. 13A), for example and without limitation a first color, and the second section 79 would display a second shunt status indication (see FIG. 13B), for example and without limitation a second color. The colors could be provided, for example and without limitation, via a number of colored lenses. A user would know whether the shunt trip assembly 20 has tripped open the associated circuit breaker 11 based on whether the first indication 75 or the second indication 79 is visible through the window 32. It will be appreciated that the optional shunt status indicator 73 and window 32 can both be omitted from the shunt trip assembly 20 without departing from the scope of the disclosed concept.

Shunt trip assembly product lines often must be produced in several different models, with each model rated for optimal performance under different operating voltage, current, and temperature conditions. When designing a shunt trip assembly 20 for use with a particular model of miniature circuit breaker, the current rating of the micro switch 54, the electromagnetic properties of the solenoid 52 and the plunger 60, and the amount of force required to drive the lever member 55 in order to trip the operating mechanism 14 of the associated circuit breaker must all be taken into account and are all affected by the characteristics of the available voltage supply and the ambient temperature conditions. For example, there is a minimum force that the plunger 60 needs to exert on the long arm 82 of the lever member 55 to cause the lever member 55 to rotate the trip cam 110 coupled to the adjacent circuit breaker operating mechanism 14 with sufficient torque to be able to open the separable contacts 18, 19. The magnitude of the force that the plunger 60 exerts on the long arm 82 of the lever member 55 is determined by the magnitude of the electromagnetic force generated by the solenoid 52 and exerted on the plunger 60 when the solenoid 52 is activated by the micro switch 54. The magnitude of the electromagnetic force that the solenoid 52 can generate is determined both by the physical dimensions of the solenoid 52 and the magnitude of the current provided via the micro switch 54.

The magnitude of the current provided to the solenoid 52 is limited by the current rating of the micro switch 54, and the dimensions of the solenoid 52 are limited by the dimensions of the shunt trip housing 30, which are often substantially the same as the dimensions of the associated circuit breaker housing 12. For example and without limitation, in a circuit breaker installation such as circuit breaker installation 10, if the circuit breaker housing assemblies 12 are sized for 1-inch wide miniature circuit breakers 11, the shunt trip housing 30 of the associated shunt trip assembly 20 will have approximately the same dimensions as the circuit breaker housing assemblies 12. Furthermore, the shunt trip assembly 20 for a circuit breaker installation 10 of a first, larger size, often cannot be used with the circuit breaker installation 10 of a second, smaller size, since a circuit breaker installation 10 is typically enclosed within an enclosure, and the shunt trip assembly 20 for the first, larger size likely will not fit inside of the enclosure constructed for the second, smaller size. For example and without limitation, the shunt trip assembly 20 for a 1-inch circuit breaker installation 10 cannot be used with a ¾-inch circuit breaker installation 10.

Accordingly, the present disclosure provides a standardized shunt trip assembly 20 that streamlines production of shunt trip assemblies 20. The standardized shunt trip assembly 20 is configured for use with any one of three solenoid models 52', 52", 52'" (which are specific iterations of solenoid 52 as described in more detail herein below, and are not numbered separately in the figures) such that the only component that differs between any shunt trip assemblies 20 produced in accordance with the disclosed concept is the particular model of solenoid 52 included (i.e., either solenoid 52', solenoid 52", or solenoid 52'"), and more particularly, the conductive coil 63 used in the included solenoid 52. As used hereinafter, the term "standardized shunt trip assembly 20" refers to a shunt trip assembly 20 from which the conductive coil 63 of the solenoid 52 is omitted, and the term "shunt trip assembly 20" continues to refer to a complete shunt trip assembly 20 that includes the conductive coil 63 of the solenoid 52. Accordingly, for any given standardized shunt trip assembly 20 produced in accordance with the disclosed concept, the dimensions and features of the shunt housing 30, the type of micro switch 54 used and the positioning of the micro switch 54 within the shunt housing 30, the dimensions and positioning of the solenoid frame 47 within the shunt housing, the dimensions of the solenoid bobbin 65, the dimensions of the solenoid housing 61, the dimensions and positioning of the plunger 60 within the shunt housing 30, and the dimensions and positioning of the lever member 55 within the shunt housing 30, are made according to one set of specifications regardless of which conductive coil is ultimately included in the solenoid 52 to complete the shunt trip assembly 20.

The present disclosure accordingly also provides three different models of solenoid 52 rated for use with the standardized shunt trip assembly 20 described above: a first solenoid 52', a second solenoid 52", and a third solenoid 52'". The only differences between the first solenoid 52', the second solenoid 52", and the third solenoid 52'" are the wound wire gauge size (AWG) and the number of turns of the wire on the bobbin 65 that suit each model of solenoid 52 for use with a particular rated voltage, while all other components of the shunt trip assembly 20, e.g. the solenoid housing 61 and the plunger 60, remain the same. These three models of solenoid 52 are all: suitable to be powered by both AC and DC shunt supply voltage sources 72; able to generate a great enough electromagnetic force for the plunger 60 to drive the lever member 55 at a predetermined minimum force of 4N at all ambient temperatures ranging from −40° C. to 60° C. while receiving a maximum current of 10 A; and structured to fit within a ¾-inch circuit breaker installation 10 (such that they necessarily also fit within a larger 1-inch circuit breaker installation 10), in accordance with an exemplary embodiment of the disclosed concept. It should be noted that solenoids 52', 52", 52'", as specific iterations/models of solenoid 52, exhibit all of the characteristics and perform all of the functions previously described with respect to solenoid 52. Solenoids 52', 52", 52'" are differentiated from one another by the magnitude of the supply voltage that each requires to operate effectively: solenoid 52' is rated for use at 12V AC/DC, solenoid 52" is rated for use at 24V AC/DC, and solenoid 52'" is rated for use at 48V AC/DC.

The predetermined minimum force at which the plunger 60 needs to drive the lever member 55 is specified to be 4N because laboratory data shows that 4N is the approximate minimum force at which the lever member 55 is able to actuate a miniature circuit breaker operating mechanism 14 in order to open the separable contacts 18, 19. In addition, ensuring that the plunger 60 drives the lever member 55 with at least 4N of force ensures that the short arm 84 of the lever member 55 pushes against the micro switch arm 70 with enough force to switch the micro switch 54 from closed state to the open state, thus preventing the solenoid coil 63 from receiving a continuous current and burning out. It will be appreciated that there is generally a greater risk of burning out a solenoid coil when a DC power supply is used rather than an AC power supply, but designing the shunt trip assembly 20 to ensure that the micro switch arm 70 will be pushed with enough force to disconnect the solenoid 52 from the shunt supply voltage source 72 by the end of the plunger stroke enables the shunt trip assembly 20 to safely use a DC power source as the shunt supply voltage source 72.

In order for the standardized shunt trip assembly 20 to operate as intended, each of the three solenoid models 52', 52", 52'" must fit within the solenoid frame 47 while being capable of generating the aforementioned 4N of force to pull the plunger 60 downward such that the lever member 55 can rotate the trip cam 110 assembly to open the separable contacts 18, 19. It will be appreciated that, for a coil 63 of a given size produced from a conductive wire of a given gauge, the electromagnetic forces produced by the coil 63 will be lesser when connected to a lesser voltage source and greater when connected to a greater voltage. Accordingly, the factor that differentiates any one of the three solenoid 52 models from the other two is the gauge of the conductive wire used to form the solenoid coil 63, as described in more detail herein with respect to a process 100 (FIG. 14), below.

Figure 14:
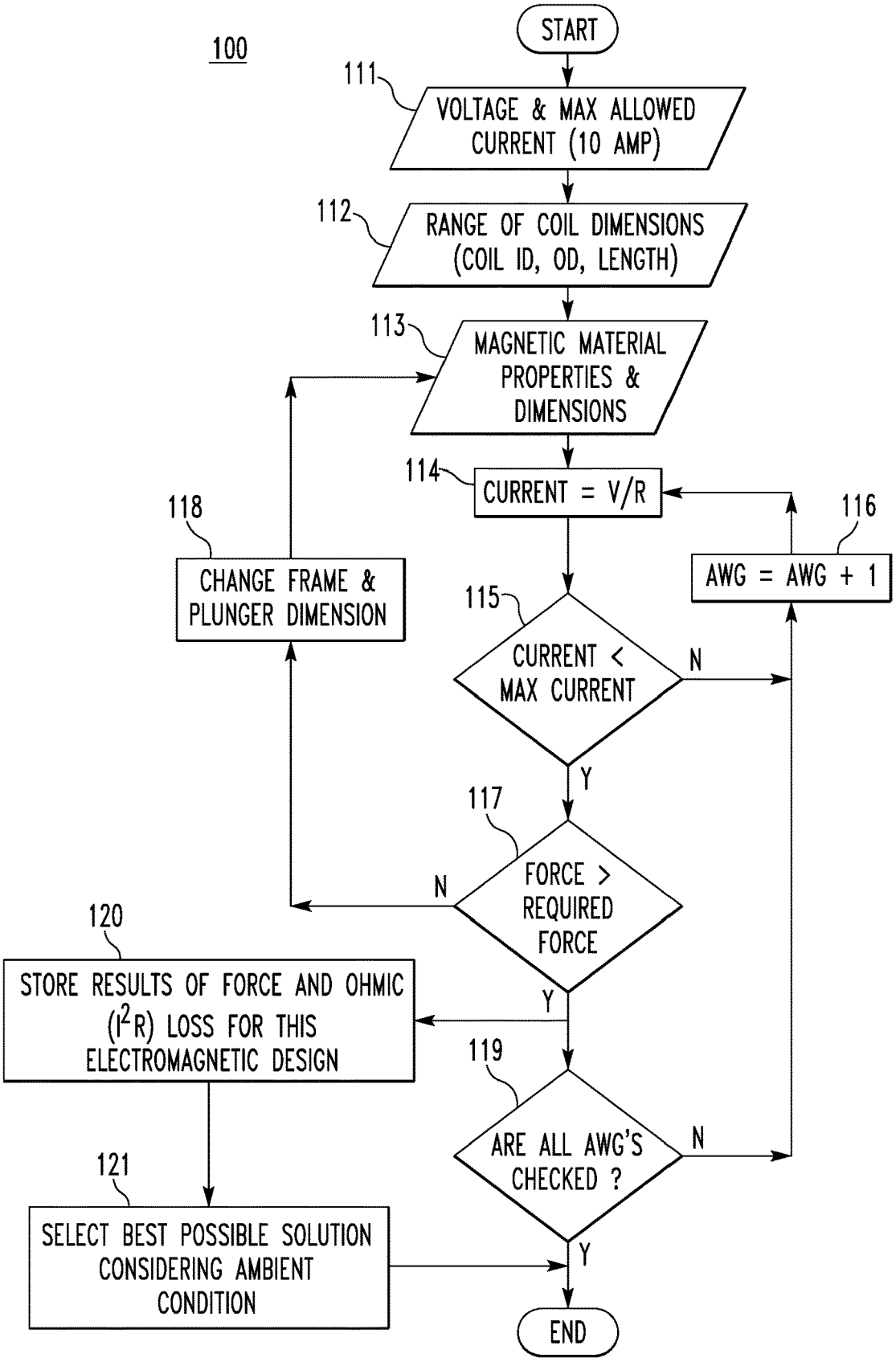
FIG. 14 is a flow chart of a process used to design a standardized shunt trip assembly and a plurality of shunt trip assembly solenoids rated for use with different supply voltages, in accordance with an exemplary embodiment of the disclosed concept.

FIG. 14 shows a flow chart of the process 100 used to design the solenoids 52', 52", and 52'" and balance of the shunt trip assembly 20 components that meet the criteria specified above. At step 111, the supply voltage and maximum current to be provided to each particular model of solenoid 52 are established, the supply voltage for solenoid 52' being 12V AC/DC, the supply voltage for solenoid 52" being 24V AC/DC, the supply voltage for solenoid 52'" being 48V AC/DC, and the maximum current for all three solenoids 52', 52", and 52'" being 10 A, which is dictated by the desire to use a micro switch 54 rated for a maximum current of 10 A in the standardized shunt assembly 20. A 10 A micro switch 54 is selected because it is a readily available and economical component, it does not occupy an undue amount of space in the shunt housing 30, and 10A is the lowest standardized switch current rating sufficient for meeting the current consumption needs of all three solenoid models as they generates a great enough electromagnetic force for the plunger 60 to drive the lever member 55 at a force of at least 4N in desired temperature range.

At steps 112 and 113, a range of solenoid coil 63 dimensions that take into consideration the magnetic material properties and dimensions of the bobbin 65, the solenoid housing 61, and the plunger 60 is proposed. The dimensions of the coil 63 include, for example and without limitation, inner diameter, outer diameter, gauge, and length of the wire used. At step 112, space in the shunt housing 30 for the coil is assigned first (i.e. only for the conductive wire of the coil 63, not for the bobbin 65, not for the solenoid housing 61, and not for the dielectric insulation tape thickness). Each model of solenoid 52 must be able to drive the lever member 55 at a force of at least 4N. Accordingly, at step 112, a design for the coil 63 that maximizes the magnetomotive force that the coil 63 can produce with 10 A or less (the maximum current which can safely be used by the preferred micro switch 54) and fits within the space constraints of the shunt housing 30 is proposed. In an exemplary embodiment, since a range of dimensions for the solenoid coil 63 is initially proposed during step 112, the coil design using the wire with the smallest gauge (AWG) is initially chosen for analysis, as all of the proposed coil designs are analyzed through process 100 by iteratively increasing the wire gauge of the proposed coil design being analyzed until all wires within the proposed range of dimensions have been analyzed. Finite element analysis (FEA) software can be used to determine an optimal placement for the solenoid coil 63 within the shunt housing 30 at step 112, and to determine what the optimal gauge of the coil conductive wire is for maximizing the magnetomotive force that can be produced with less than the maximum allowed current. At step 113, the remaining space in the shunt housing 30 is subsequently distributed between the plunger 60, the solenoid housing, the bobbin 65, and dielectric test clearances.

Steps 112, 113, 114, 115, 116 and 117 can be performed iteratively and repeatedly without departing from the scope of the disclosed concept, as adjustments made to the solenoid coil 63 design may, for example and without limitation, necessitate adjustments in the design of the solenoid housing 61, the plunger 60, and/or other elements of the actuating assembly 50 and vice versa. In one non-limiting example, after the plunger 60, the solenoid housing 61, the bobbin 65, and dielectric test clearances have been added to the design at step 113, the FEA software can calculate the force that should be generated by the coil 63 in the proposed setup. In this example, if the calculated force is less than desired, the magnetic field density plot of the magnetic components can be checked. If the magnetic components are deeply saturated, one solution would be to increase the cross-sectional area of the magnetic components while decreasing the space for the coil 63 and keeping the space allotted for the bobbin 65 and the dielectric test clearances fixed.

The resistance of the conductive wire used to form the solenoid coil 63 must be taken into account to ensure that no more than 10 A of current will be drawn by the solenoid 52 when the shunt voltage supply source is powered on, as a solenoid coil 63 of a given size will draw more current from a higher supply voltage (e.g., the 48V supply to be used with solenoid 52''') than from a lower supply voltage (e.g., the 12V supply to be used with solenoid 52'). For example and without limitation, assuming that a longer wire and a shorter wire have the same cross section and conductive properties, the longer wire will have greater resistance than the shorter wire, and for two wires of the same length with the same conductive properties, a higher gauge (thinner) wire will have a greater resistance than a lower gauge (thicker) wire. Accordingly, at step 114, the maximum current I that will flow through the proposed design for the solenoid 52 is calculated according to Ohm's Law in Equation (1) below:

$$I=V/R \tag{1}$$

wherein V is the voltage to be provided by the shunt supply voltage source 72 for the specific model of solenoid 52 being designed (i.e., either 12V AC/DC, 24V AC/DC, or 48V AC/DC) and R is the resistance of the solenoid coil design proposed at step 112, which depends on both the gauge and length of the conductive wire proposed for use in the coil 63, among other factors.

At step 115, the current I calculated at step 114 is compared to the 10 A rating of the preferred micro switch 54. If the calculated current I is not less than 10 A, the process 100 proceeds to step 116, where the gauge of the specific conductive wire proposed at step 112 is increased by 1 and automatically adjusted for the gauge winding length based on the space available in the solenoid housing 61. The process 100 then returns to step 114. Steps 114 through 116 are repeated until the current I calculated at step 114 is determined at step 115 to be less than the 10 A maximum current rating of the preferred micro switch 54. In one non-limiting example, the coil packing factor of winding coil on to the bobbin is considered to be 80%, but not limited to it.

At step 117, the force exerted by the plunger 60 on the long arm 82 of the lever member 55 is determined. If the force is greater than the 4N required to actuate the adjacent circuit breaker operating mechanism 14 and open the separable contacts 18, 19, then the analysis for the particular wire gauge currently being analyzed concludes and progresses to step 119 while the calculated force and ohmic loss results for that particular qualified electromagnetic design are simultaneously stored at step 120. If, however, the force calculated at step 117 is less than 4N, the dimensions of the solenoid frame 47 and the plunger 60 are adjusted at step 118, and the process 100 returns to step 113.

At Step 119, if any of the wires proposed for the solenoid coil 63 at step 112 have not yet been analyzed using process 100, the process 100 returns to step 116 and the next-highest gauge wire from the range of wires proposed at step 112 for the solenoid coil 63 is chosen and analyzed. Steps 116, 114, 115, 117, 118 and 113 are iterated and repeated in a loop as necessary and as shown in FIG. 14. During iteration, if the force requirement criteria is met at step 117, the calculated force and ohmic loss results for that particular qualified electromagnetic design are stored at step 120, the process 100 proceeds to step 119 to analyze any remaining wire gauge options. Once no wire gauges proposed at step 112 remain when the process reaches step 119, the process can commence to step 121 after the last iteration of step 120. At step 121, the user can select the design of the solenoid 52 best suited for the range of ambient temperatures spanning from −40° C. to +60° C. from the results stored at previous iterations of step 120 to end the process 100.

In calculating the force exerted by the plunger 60 on the long arm 82 of the lever member 55, the length of the long arm 82 contributing to mechanical advantage versus the plunger stroke/position inside the solenoid 52 for the initial pull force can be optimized by changing the distance "X" between the lever fulcrum (i.e. the region of the lever member 55 coupled to the axle 48) and the point where the plunger 60 is coupled to the long arm 82 of the lever member 55. The further inside the solenoid 52 the plunger 60 is disposed, the greater the pull force of the solenoid 52 on the plunger 60 is. At the same time, the greater the length of the lever long arm 82, the less force is required to be exerted on the plunger end 86 of the lever member 55 to actuate the circuit breaker operating mechanism 14. However, increasing the length of the lever long arm 82 eventually increases the plunger 60 stroke. Accordingly, it will be appreciated that optimization can be achieved using any of a variety of known principles.

Figure 15A:
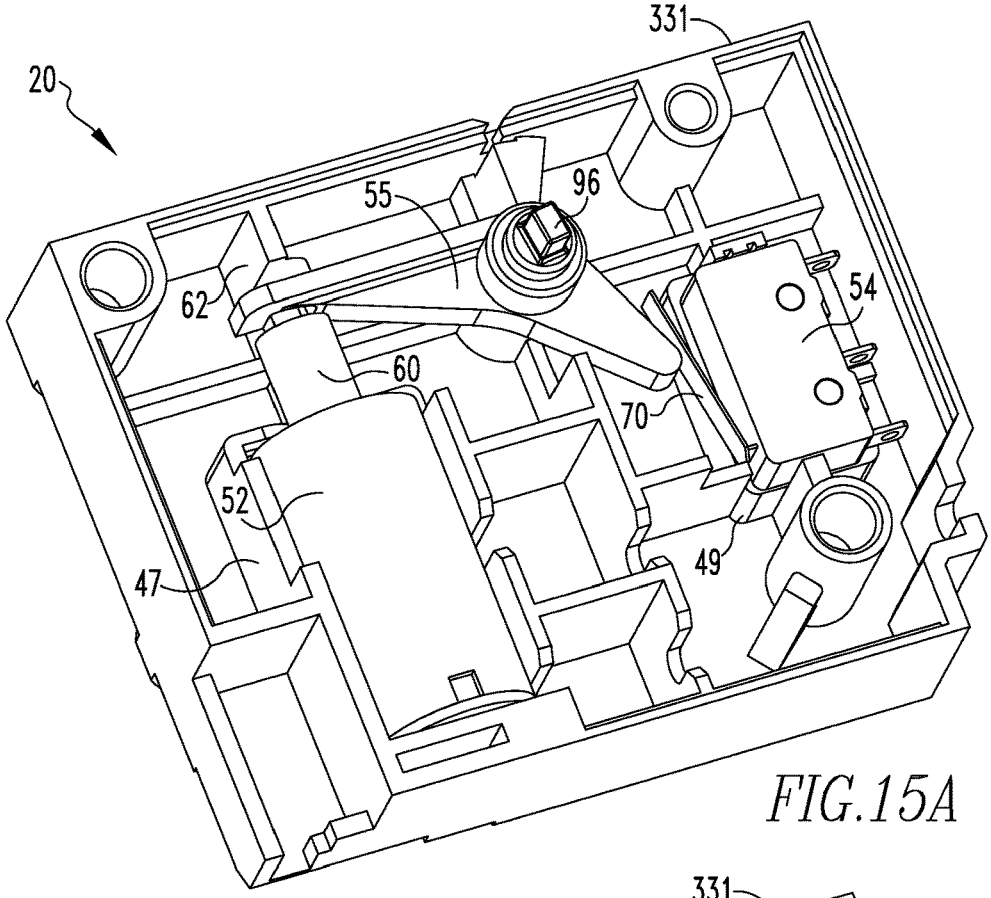
FIG. 15A shows an isometric view of the shunt trip assembly in FIG. 1D prior to actuation with a plunger stop incorporated into the shunt housing, in accordance with an exemplary embodiment of the disclosed concept.
Figure 15B:
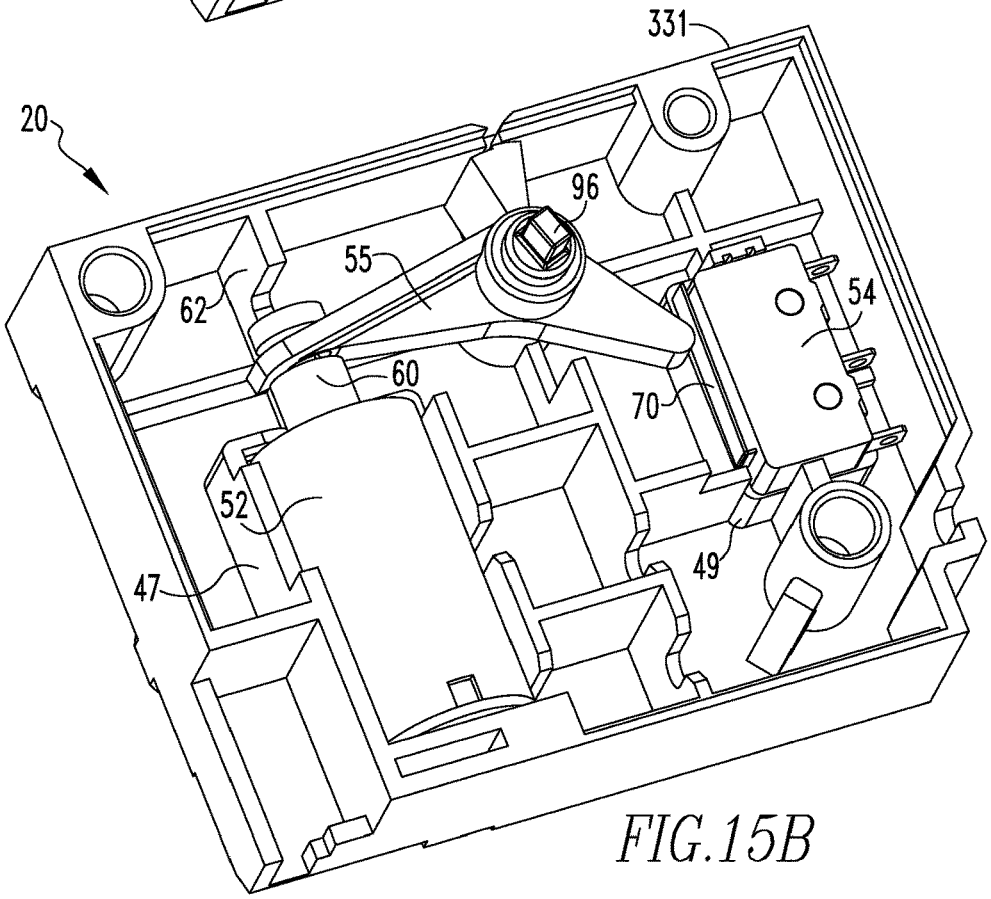
FIG. 15B shows an isometric view of the shunt trip assembly in FIG. 1D after actuation with a plunger stop incorporated into the shunt housing, in accordance with an exemplary embodiment of the disclosed concept.

Referring to FIGS. 15A and 15B, in an exemplary embodiment, a plunger stop 62 can be included in the shunt housing 30 to optimize the plunger stroke by preventing the plunger 60 from withdrawing too far outside of the solenoid 52 when the shunt trip assembly 20 is reset after a trip. If the plunger 60 withdraws too far outside of the solenoid 52, the solenoid 52 will have to generate an unnecessarily greater force than it would otherwise have had to, and there will be a longer lag time between activation of the solenoid 52 and actuation of the circuit breaker operating mechanism 14. It will be appreciated that the plunger stop 62 can be omitted from the shunt housing 30 without departing from the scope of the disclosed concept.

Because the configuration of the solenoid housing 61 and bobbin 65 are constant across all three solenoid models 52', 52'', 52''' and only the gauge of the conductive wire and number of turns of the wire around the bobbin 65 change between models, the solenoid housing 61 and bobbin 65 are both strategically designed to ensure that the solenoid 52 can generate a strong enough electromagnetic force to drive the plunger 60 and lever 55 to open the circuit breaker separable contacts 18, 19, no matter which specific model of the solenoid 52 is being used in the standardized shunt trip assembly 20. First, in an exemplary embodiment of the disclosed concept, a single bay solenoid 52 comprised of a single bobbin 65 such as that shown in FIGS. 1D, 11A and 11B is used, as opposed to a double bay solenoid 52 comprised of two bobbins (not numbered) as shown in FIGS. 1B, 8, 9, and 10. Referring to FIGS. 8, 9, and 10, the double bay solenoid 52 includes two separate coils (not numbered) that are electrically connected in series via a number of lugs 53 which additionally provide an electrical coupling point for conductors used to electrically connect the solenoid coils to the micro switch 54. As shown in FIGS. 11A and 11B, in the single bay design, the ends of the coil 63 conductive wires are taken out of the solenoid housing 61 and used to electrically connect to the micro switch 54, rather than using external components such as the lugs 53 used in the double bay design.

The double bay and single bay designs are compared because there are advantages to each design. The lugs 53 of the double bay design provide a straightforward connection point for electrically connecting the solenoid 52 to the micro switch 54. However, the lugs 53 increase the electrical resistance of the solenoid 52 in the double bay design, reducing the maximum possible magnitude of the current that can flow through the solenoid 52 and therefore reducing the maximum possible magnitude of the electromagnetic forces generated by the solenoid 52. The single bay design eliminates the external source of resistance introduced by the lugs 53.

Figure 16A:
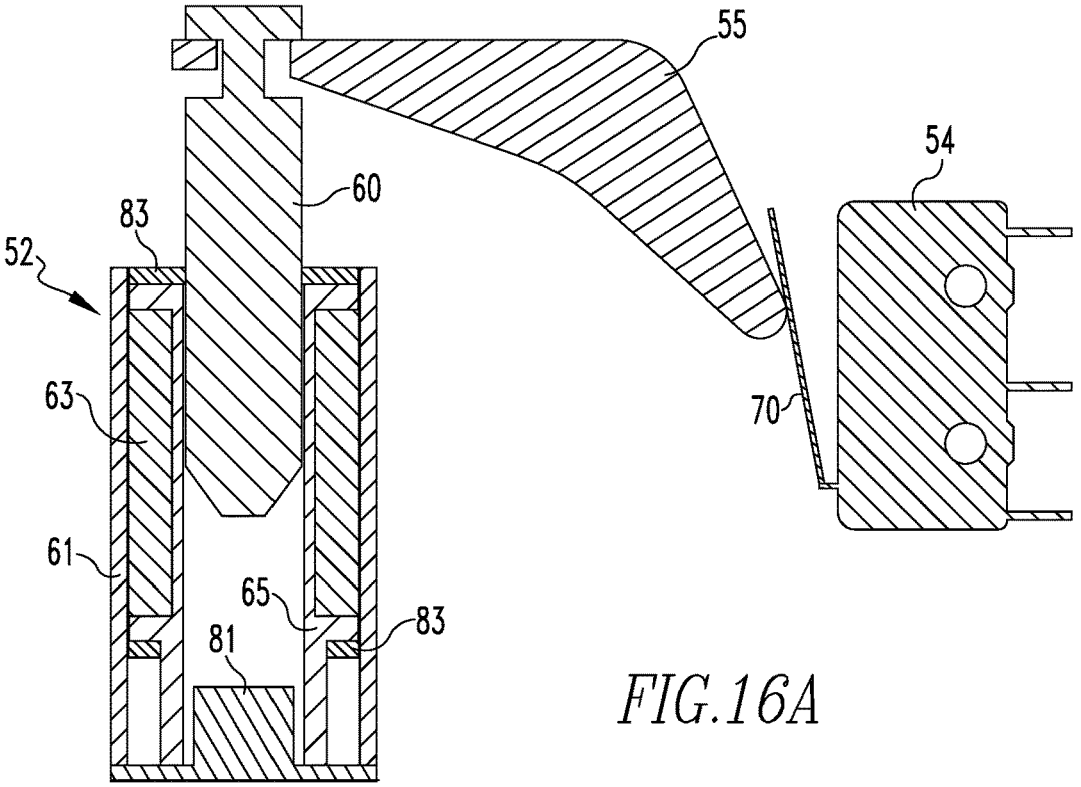
FIG. 16A shows a cross-sectional view of a solenoid incorporating a magnetic heel and magnetic rings prior to actuation of the shunt trip assembly, in accordance with an exemplary embodiment of the disclosed concept.
Figure 16B:
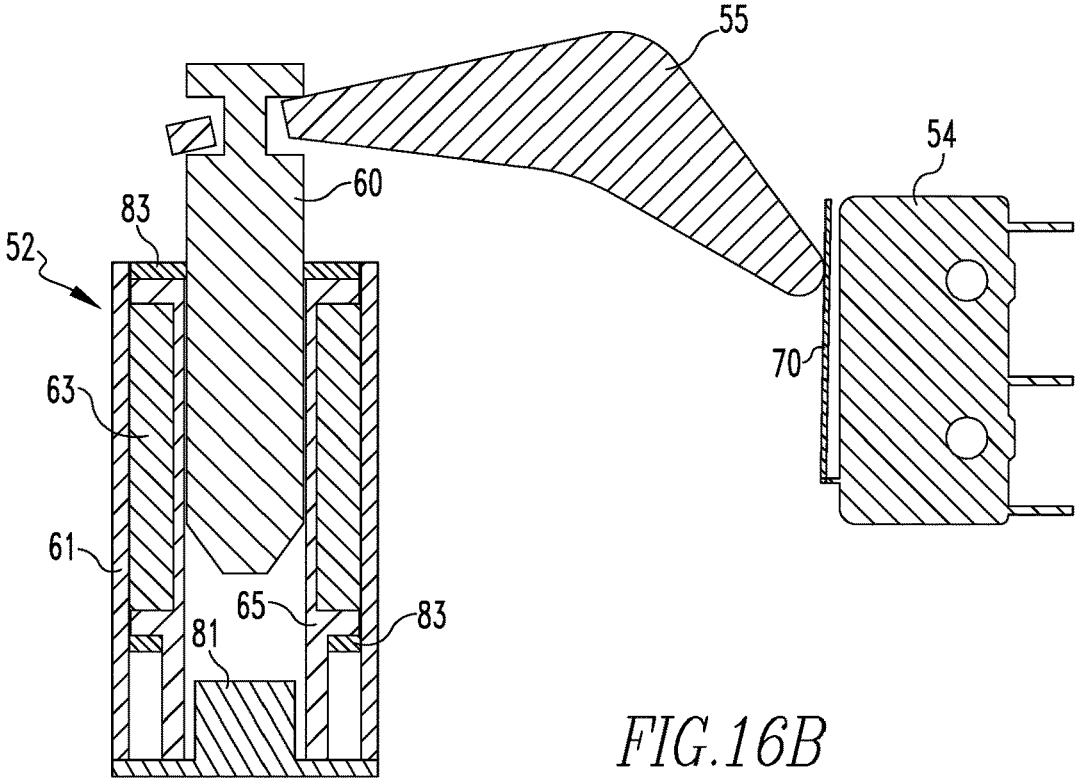
FIG. 16B shows a cross-sectional view of a solenoid incorporating a magnetic heel and magnetic rings after actuation of the shunt trip assembly, in accordance with an exemplary embodiment of the disclosed concept.

Second, referring to cross-sectional views of the solenoid 52 shown in FIGS. 16A and 16B, in an exemplary embodiment of the disclosed concept, a magnetic heel 81 can be included in the bottom (relative to the views shown in FIGS. 16A and 16B) of the solenoid housing 61 and a number of magnetic rings 83 can be disposed throughout the housing 61 as shown in order to strengthen the electromagnetic field produced when the electromagnet coil 63 is electrically excited. Referring again to FIG. 14 and the process 100, the process 100 proceeds to step 118 if it is determined at step 117 that the force exerted by the plunger 60 on the long arm 82 of the lever member 55 is less than 4N. At step 117, it is assumed that the FEA software has determined how to optimize the force exerted on the lever member 55 by the actuation of the plunger 60 by the coil 63 and the optimal placement of the coil 63 within the shunt housing 30, which is why the solenoid housing 61 and plunger 60 dimensions are adjusted at step 118, rather than the attributes of the coil 63. At step 118, in addition to adjusting the dimensions of the solenoid housing 61 and plunger 60, the materials from which the solenoid housing 61, plunger 60, magnetic heel 81, and/or magnetic rings 83 are produced may be adjusted as well. For example and without limitation, the materials from which these components are produced may be replaced by materials with higher magnetic flux density saturation points, and the number of magnetic rings used can also be adjusted.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof

What is claimed is:

1. A shunt trip assembly structured to be operatively coupled to a number of circuit breakers, the shunt trip assembly comprising:

a standardized shunt arrangement, the standardized shunt arrangement comprising:

a shunt housing comprising a mounting wall;

a micro switch, the micro switch being coupled to the mounting wall and configured to be selectively powered by a power source;

a solenoid frame coupled to the mounting wall;

a solenoid housing coupled to the solenoid frame;

a bobbin contained within the solenoid housing;

a ferromagnetic plunger movably coupled to the solenoid housing so as to be disposed partially within the solenoid housing;

a lever member coupled at a fulcrum of the lever member to the mounting wall via an axle, the lever member comprising:

a first arm disposed between the fulcrum and a first end of the lever member, the first end of the lever member being coupled to the plunger;

a second arm disposed between the fulcrum and a second end of the lever member, the second end being disposed opposite the first end and adjacent to the micro switch arm; and a rotational coupling body coupled to the fulcrum and structured to be operatively coupled to an operating mechanism of the number of circuit breakers; and a solenoid coil comprised of a conductive wire structured to be wound around the bobbin within the solenoid housing and structured to receive power from the micro switch, wherein the micro switch is structured to provide current from the power source to the solenoid in response to the micro switch receiving power when in a closed state, wherein the plunger is structured to move further into the solenoid housing and cause the lever member to rotate the rotational coupling body to actuate the operating mechanism of the number of circuit breakers in response to the solenoid receiving current, and wherein the lever member is structured to switch the micro switch to an open state and disconnect the solenoid from the power source in response to the plunger causing the lever member to rotate, wherein the standardized shunt arrangement is configured to be used with a plurality of AC and DC voltage levels provided by the power source, wherein the solenoid coil is structured to be powered by one specified voltage level from the plurality of AC and DC voltage levels, wherein the solenoid is structured to draw less current from the power source than the maximum current for which the micro switch is rated, wherein the standardized shunt arrangement is configured and the solenoid is structured such that, for a range of temperatures spanning −40° C. to +60° C. and regardless of what specified voltage level the solenoid is structured to be powered by, the plunger is structured to exert at least a predetermined amount of force on the first end of the lever member in response to current being provided to the solenoid from the power source.

2. The shunt trip assembly of claim 1, wherein the predetermined amount of force exerted by the plunger on the first end of the lever is 4 Newtons.

3. The shunt trip assembly of claim 1, wherein the plurality of AC and DC voltage levels includes 12 volts AC/DC, 24 volts AC/DC, and 48 volts AC/DC.

4. The shunt trip assembly of claim 1, wherein the shunt housing includes a window through which a region of the lever member is visible from the exterior of the shunt housing, wherein the region of the lever member includes a first section and a second section, wherein the first section is visible through the window prior to an activation of the shunt trip assembly to actuate the operating mechanism, wherein the second section is visible through the window after an actuation of the operating mechanism by the shunt trip assembly.

5. The shunt trip assembly of claim 1, wherein the maximum current that the micro switch is rated to carry is 10 amps.

6. The shunt trip assembly of claim 1, wherein the solenoid housing is structured to have a predetermined set of dimensions so as to fit within the solenoid frame, regardless of which specified voltage level the solenoid coil is structured to be powered by.

7. The shunt trip assembly of claim 6, wherein the bobbin is structured to have a predetermined set of dimensions regardless of which specified voltage level the solenoid coil is structured to be powered by, and wherein a gauge of the solenoid coil corresponds to which specified voltage level the solenoid coil is structured to be powered by.

8. The shunt trip assembly of claim 1, wherein the solenoid housing includes a magnetic heel disposed within an interior of the solenoid housing at a base of the solenoid housing.

9. The shunt trip assembly of claim 1, wherein the solenoid housing further comprises a number of magnetic rings disposed around a central axis of the bobbin and adjacent to the solenoid coil on an interior surface of the solenoid housing.

10. The shunt trip assembly of claim 1, wherein the shunt housing comprises a number of protrusions on a lateral sidewall of the shunt housing facing an adjacent circuit breaker of the number of circuit breakers, wherein the number of protrusions on the shunt housing lateral sidewall are structured to mate with a number of depressions on a surface of a sidewall of the adjacent circuit breaker such that a snug fit is created between the shunt housing lateral sidewall and the sidewall of the adjacent circuit breaker, wherein the snug fit prevents tilting of the shunt trip assembly relative to the number of circuit breakers.

11. A shunt trip assembly structured to be operatively coupled to a number of circuit breakers, the shunt trip assembly comprising:

a standardized shunt arrangement, the standardized shunt arrangement comprising:

a shunt housing comprising a mounting wall;

a micro switch, the micro switch being coupled to the mounting wall and configured to be selectively powered by a power source;

a solenoid frame coupled to the mounting wall;

a solenoid housing coupled to the solenoid frame;

a bobbin contained within the solenoid housing;

a ferromagnetic plunger movably coupled to the solenoid housing so as to be disposed partially within the solenoid housing;

a lever member coupled at a fulcrum of the lever member to the mounting wall via an axle, the lever member comprising:

a first arm disposed between the fulcrum and a first end of the lever member, the first end of the lever member being coupled to the plunger;

a second arm disposed between the fulcrum and a second end of the lever member, the second end being disposed opposite the first end and adjacent to the micro switch arm; and a rotational coupling body coupled to the fulcrum and structured to be operatively coupled to an operating mechanism of the number of circuit breakers; and a solenoid coil comprised of a conductive wire structured to be wound around the bobbin within the solenoid housing and structured to receive power from the micro switch, wherein the micro switch is structured to provide current from the power source to the solenoid in response to the micro switch receiving power when in a closed state, wherein the plunger is structured to move further into the solenoid housing and cause the lever member to rotate the rotational coupling body to actuate the operating mechanism of the number of circuit breakers in response to the solenoid receiving current, and wherein the lever member is structured to switch the micro switch to an open state and disconnect the solenoid from the power source in response to the plunger causing the lever member to rotate, wherein the standardized shunt arrangement is configured to be used with any one of a plurality of voltage levels provided by the power source, including 12 volts AC/DC, 24 volts AC/DC, and 48 volts AC/DC, wherein the solenoid coil is structured to be powered by one specified voltage level from the plurality of AC and DC voltage levels, wherein the solenoid is structured to draw less current from the power source than the maximum current for which the micro switch is rated, wherein the standardized shunt arrangement is configured and the solenoid is structured such that, for a range of temperatures spanning −40° C. to +60° C. and regardless of what specified voltage level the solenoid is structured to be powered by, the plunger is structured to exert at least a predetermined amount of force on the first end of the lever member in response to current being provided to the solenoid from the power source.

12. The shunt trip assembly of claim 11, wherein the predetermined amount of force exerted by the plunger on the first end of the lever is 4 Newtons.

13. The shunt trip assembly of claim 11, wherein the shunt trip assembly is structured to fit within both a single housing shunt enclosure for a ¾-inch circuit breaker installation and a double housing shunt enclosure for a 1-inch circuit breaker installation, wherein the shunt trip assembly is structured to be used with either of a ¾-inch circuit breaker installation or a 1-inch circuit breaker installation.

14. The shunt trip assembly of claim 11, wherein the shunt housing includes a window through which a region of the lever member is visible from the exterior of the shunt housing, wherein the region of the lever member includes a first section and a second section, wherein the first section is visible through the window prior to an activation of the shunt trip assembly to actuate the operating mechanism, wherein the second section is visible through the window after an actuation of the operating mechanism by the shunt trip assembly.

15. The shunt trip assembly of claim 11, wherein the maximum current that the micro switch is rated to carry is 10 amps.

16. The shunt trip assembly of claim 11, wherein the solenoid housing is structured to have a predetermined set of dimensions so as to fit within the solenoid frame, regardless of which specified voltage level the solenoid coil is structured to be powered by.

17. The shunt trip assembly of claim 16, wherein the bobbin is structured to have a predetermined set of dimensions regardless of which specified voltage level the solenoid coil is structured to be powered by, and wherein a gauge of the solenoid coil corresponds to which specified voltage level the solenoid coil is structured to be powered by.

18. The shunt trip assembly of claim 11, wherein the solenoid housing includes a magnetic heel disposed within an interior of the solenoid housing at a base of the solenoid housing.

19. The shunt trip assembly of claim 11, wherein the solenoid housing further comprises a number of magnetic rings disposed around a central axis of the bobbin and adjacent to the solenoid coil on an interior surface of the solenoid housing.

20. The shunt trip assembly of claim 11, wherein the shunt housing comprises a number of protrusions on a lateral sidewall of the shunt housing facing an adjacent circuit breaker of the number of circuit breakers, wherein the number of protrusions on the shunt housing lateral sidewall are structured to mate with a number of depressions on a surface of a sidewall of the adjacent circuit breaker such that a snug fit is created between the shunt housing lateral sidewall and the sidewall of the adjacent circuit breaker, wherein the snug fit prevents tilting of the shunt trip assembly relative to the number of circuit breakers.

* * * * *